US008454319B2

(12) United States Patent
Kitani

(10) Patent No.: US 8,454,319 B2
(45) Date of Patent: Jun. 4, 2013

(54) PRESSURIZED-OIL SUPPLY AMOUNT CONTROL DEVICE FOR VEHICLE-MOUNTED CRANE

(75) Inventor: Tomohiko Kitani, Sakura (JP)

(73) Assignee: Furukawa Unic Corporation, Chuo-ku, Tokyo (JP)

( * ) Notice: Subject to any disclaimer, the term of this patent is extended or adjusted under 35 U.S.C. 154(b) by 624 days.

(21) Appl. No.: 12/513,725

(22) PCT Filed: Oct. 19, 2007

(86) PCT No.: PCT/JP2007/070434

§ 371 (c)(1),
(2), (4) Date: May 6, 2009

(87) PCT Pub. No.: WO2008/056526

PCT Pub. Date: May 15, 2008

(65) Prior Publication Data

US 2010/0054956 A1 Mar. 4, 2010

(30) Foreign Application Priority Data

Nov. 9, 2006 (JP) ..... 2006-303660
Nov. 30, 2006 (JP) ..... 2006-324506
Dec. 22, 2006 (JP) ..... 2006-345394

(51) Int. Cl.
*F04B 49/03* (2006.01)
*F04B 49/02* (2006.01)

(52) U.S. Cl.
USPC ..... 417/10; 417/26

(58) Field of Classification Search
USPC ..... 417/1–10, 24, 26, 42
See application file for complete search history.

(56) References Cited

FOREIGN PATENT DOCUMENTS

| | | | |
|---|---|---|---|
| JP | 50-008394 U | | 1/1975 |
| JP | 60-73901 U | | 5/1985 |
| JP | 61-126388 | | 6/1986 |
| JP | 01-261503 | | 10/1989 |
| JP | 5-039192 A | | 2/1993 |
| JP | 05-051883 U | | 7/1993 |
| JP | 05051883 U | * | 7/1993 |
| JP | 07-166912 | | 6/1995 |
| JP | 08-282975 | | 10/1996 |

(Continued)

OTHER PUBLICATIONS

An Office Action dated Jul. 23, 2010 issued by the Russian Patent Office for the corresponding Russian Patent Application No. 2009121825 and the English translation of the Office Action.

(Continued)

*Primary Examiner* — Karabi Guharay
*Assistant Examiner* — Nathaniel Lee
(74) *Attorney, Agent, or Firm* — Young Basile

(57) ABSTRACT

Disclosed herein are embodiments of a pressurized-oil supply amount control device for a vehicle-mounted crane which has a dual pump system and which is capable of further inhibiting possible noise from an engine and improving fuel consumption. A predetermined control function is set for a controller 2 for the pressurized-oil supply amount control device. Three regions R1, R2, R3 are set for the predetermined control function according to the rate of an operation signal input. Based on the predetermined control function, the rotation speed of the engine 6 is controlled, and the flow rate of pressurized oil is controlled by a flow rate control valve 5. This increases the total flow rate G of pressurized oil supplied to a control valve 3 in proportion to the rate of the operation signal input to the crane.

7 Claims, 9 Drawing Sheets

FOREIGN PATENT DOCUMENTS

| | | | | |
|---|---|---|---|---|
| JP | 09-209411 | | | 8/1997 |
| JP | 09-216790 | | | 8/1997 |
| JP | 2578045 | Y2 | | 5/1998 |
| JP | 2006-290561 | | | 10/2006 |
| JP | 2006290561 | A | * | 10/2006 |
| JP | 2006-119152 | | | 11/2006 |
| JP | 2007-290806 | | | 11/2007 |

OTHER PUBLICATIONS

English Translation of International Preliminary Report on Patentability mailed Jun. 4, 2009.

Office Action dated Sep. 27, 2011 issued by the Japan Patent Office for the corresponding Japanese Patent Application No. 2006-119152 and an English translation thereof.

Translation of Japanese Office Action, Patent Application No. JP 2006-345394 dated Jun. 19, 2012.

Translation of Japanese Office Action, Patent Application No. JP 2006-303660 dated Jun. 19, 2012.

Extended European Search Report for corresponding EP Application No. 07830168.6, Dec. 6, 2012.

* cited by examiner

PRESSURIZED-OIL SUPPLY AMOUNT CONTROL DEVICE FOR VEHICLE-MOUNTED CRANE

TECHNICAL FIELD

The present invention relates to a pressurized-oil supply amount control device for a vehicle-mounted crane mounted in a vehicle such as a truck, and in particular, to a pressurized-oil supply amount control device suitable for vehicle-mounted crane configured to operate using, as a hydraulic source, a hydraulic pump driven by an engine of the vehicle.

BACKGROUND

In the technique described in Japanese Patent Publication No. 6-6476, the pressurized-oil supply amount control device includes a main hydraulic pump 7 and a sub hydraulic pump 8 simultaneously driven by an engine 6, for example, as shown in FIG. 9. The pressurized-oil supply amount control device also includes a flow rate control valve 5 that controls the flow rate of pressurized oil discharged from the sub hydraulic pump 8. Thus, pressurized oil discharged from the main hydraulic pump 7 is merged with pressurized oil discharged from the sub hydraulic pump 8 and the flow rate of which is adjusted to any value by the flow rate control valve 5. The merged pressurized oil is then supplied to a control valve 3. The pressurized-oil supply amount control device includes an accelerator cylinder 4 and a governor 20 that controls the fuel injection amount of the engine 6. The accelerator cylinder 4 and the governor 20 are coupled together via a first link 21. Furthermore, the accelerator cylinder 4 and the flow rate control valve 5 of the sub hydraulic pump 8 are coupled together via a second link 22 operated simultaneously with the first link 21. Thus, the accelerator cylinder 4 and the flow rate control valve 5 are in a given operational relationship that allows the pressurized-oil supply amount to be reliably controlled.

In response to an operation input from a controller 120, the accelerator cylinder 4, which controls the rotation speed of the engine 6, is controlled. At the same time, the flow rate control valve 5 of the sub hydraulic pump 8, coupled to the accelerator cylinder 4, is operated via the second link 22. Thus, the pressurized oil discharged from the main hydraulic pump 7 is merged with the pressurized oil discharged from the sub hydraulic pump 8 and the flow rate of which is adjusted to a predetermined value by the flow rate control valve 5. The merged pressurized oil is then supplied to the control valve 3 in the crane.

The pressurized-oil supply amount control device described in Japanese Patent Publication No. 6-6476 enables possible noise from the engine to be inhibited and allows fuel consumption to be improved compared to, for example, a vehicle-mounted crane equipped only with a main hydraulic pump.

The displacement of the main hydraulic pump 7 is set such that the main hydraulic pump 7 can discharge pressurized oil of a rated pressure so as to prevent the engine from being stalled even in an idling condition in which the rotation speed and rotating torque of the engine are low. Furthermore, the displacement of the sub hydraulic pump 8 is set such that after the engine rotation speed and the rotating torque increase, the sub hydraulic pump 8 can be driven simultaneously with the main hydraulic pump 7 to discharge pressurized oil of the rated pressure.

The objective of this system is to, if the engine rotation speed and the rotating torque are low, return the pressurized oil from the sub hydraulic pump 8 to the tank 9 via the flow rate control valve 5, while supplying only the pressurized oil from the main hydraulic pump 7 to the control valve 3 side, in order to reduce a torque load on the engine 6. Furthermore, if the engine rotation speed and thus the rotating torque increase, the flow rate control valve 5, controlling the flow rate of the pressurized oil from the sub hydraulic pump 8, is opened. The pressurized oil from the main hydraulic pump 7 is thus merged with the pressurized oil from the sub hydraulic pump 8 to increase the pressurized-oil supply amount by a required value, while minimizing the engine rotation speed. Thus, required energy is saved, and possible noise is reduced.

Here, to achieve further energy saving and noise reduction in a pressurized oil supply amount control device, the pressurized oil from the sub hydraulic pump 8 may be merged while the engine rotation speed is lower. However, different types of vehicle on which the crane is mounted or different vehicle manufacturers use different engine rotation speeds to generate a rotating torque at which the main hydraulic pump 7 and the sub hydraulic pump 8 can be simultaneously driven to discharge pressurized oil of the rated pressure. Thus, the pressurized oil from the sub hydraulic pump 8 needs to be merged at the engine rotation speed depending on each vehicle.

However, in the technique described in Japanese Patent Publication No. 6-6476, the accelerator cylinder 4 and the governor 20 are coupled together via the first link 21, and the accelerator cylinder 4 and the flow rate control valve 5 are coupled together via the second link 22. Consequently, the relationship between the engine rotation speed and the control flow rate of the flow rate control valve 5 cannot be changed. Thus, to prevent the possible insufficiency of rotating torque of the engine even in a vehicle having an engine with different characteristics or the like, the device is set such that the engine rotation speed is increased to a slightly larger value to ensure the required rotating torque before the pressurized oil from the sub hydraulic pump 8 is merged. That is, the engine rotation speed increases almost in proportion to the travel distance of the link over the entire range of the travel distance. Thus, in order to always prevent the possible insufficiency of rotating torque of the engine, the device is set such that the engine rotation speed is increased to the slightly larger value to ensure the required rotating torque before the pressurized oil from the sub hydraulic pump 8 is merged.

Thus, according to the technique described in Japanese Patent Publication No. 6-6476, for example, in a vehicle that only needs a lower engine rotation speed to generate a rotating torque at which the main hydraulic pump 7 and the sub hydraulic pump 8 can be simultaneously driven to discharge pressurized oil of the rated pressure, the engine rotation speed may be increased more than necessary. Therefore, the technique described in Japanese Patent Publication No. 6-6476 still has room for improvement in terms of energy saving and noise reduction.

BRIEF SUMMARY

Thus, the present invention has been made in view of the above noted problems. An object of the present invention is to provide a pressurized-oil supply amount control device for a vehicle-mounted crane with a dual pump system which device enables possible noise from the engine to be inhibited and allows fuel consumption to be improved.

To accomplish the object, a first embodiment provides a pressurized-oil supply amount control device for controlling a supply amount of pressurized oil supplied to a crane mounted on a vehicle. The pressurized-oil supply amount control device comprises a main hydraulic pump and a sub hydraulic pump simultaneously driven by an engine of the vehicle, a flow rate control valve adjusting the flow rate of the pressurized oil discharged from the sub hydraulic pump to a desired value and a controller capable of controlling rotation speed of the engine and the flow rate control valve in response to an operation signal input to the crane. The pressurized-oil supply amount control device merges pressurized oil discharged from the main hydraulic pump with pressurized oil from the sub hydraulic pump adjusted by the flow rate control valve and supplied the merged pressurized oil to a control valve used to drive the crane. The pressurized-oil supply amount control device includes engine rotation speed control means for controlling the rotation speed of the engine, and discharge flow rate control means for controlling the flow rate of pressurized oil discharged from the flow rate control valve. The discharge flow rate control means includes a first flow rate control in which the flow rate control valve is fully close to supply only the pressurized oil from the main hydraulic pump to the control valve, a second flow rate control in which the pressurized oil from the sub hydraulic pump is merged with the pressurized oil discharged from the main hydraulic pump so that discharge amount of the merged pressurized oil varies in proportion to rate of the operation signal input before the merged pressurized oil is supplied to the control valve, and a third flow rate control in which the flow rate control valve is fully open to supply the control valve with possible maximum amount of pressurized oil discharged from the main hydraulic pump and the sub hydraulic pump.

The engine rotation speed control means includes a first rotation speed control in which the rotation speed of the engine is increased so as to vary in proportion to the rate of the operation signal input from an idling rotation speed to second rotation speed ensuring a necessary and sufficient torque for preventing insufficiency of a rotating torque of the engine, a second rotation speed control in which the rotation speed of the engine is maintained at the second engine rotation speed, and a third rotation speed control in which the rotation speed of the engine is increased in proportion to the rate of the operation signal input from the second engine rotation speed to a third engine rotation speed higher than the second engine rotation speed. The controller performs the first rotation speed control and correspondingly the first flow rate control when the rate of the operation signal input is in a first region in which the rate is lower than a first rate, performs the second rotation speed control and correspondingly the second flow rate control when the rate of the operation signal input is in a second region in which the rate is equal to or higher than the first rate and lower than a second rate higher than the first rate, and performs the third rotation speed control and correspondingly the third flow rate control when the rate of the operation signal input is in a third region in which the rate is equal to or higher than the second rate.

In the pressurized-oil supply amount control device according to the first embodiment, when the rate of the operation signal input is in the first region, the first rotation speed control is performed in which the discharge flow rate control means performs the first flow rate control to discharge only the pressurized oil from the main hydraulic pump and the engine rotation speed control means correspondingly increases the rotation speed of the engine so as to vary in proportion to the rate of the operation signal input from the idling rotation speed to the second rotation speed ensuring the necessary and sufficient torque for preventing insufficiency of the rotating torque of the engine. Thus, when only a small discharge amount of pressurized oil is required as in the case of, for example, an inching operation, energy saving and noise reduction can be achieved by reducing the engine rotation speed.

When the rate of the operation signal input is in the second region, the engine rotation speed control means performs the second flow rate control to maintain the second engine rotation speed, which is necessary and sufficient for preventing the insufficiency of the rotating torque of the engine. At the second engine rotation speed, the discharge flow rate control means performs the corresponding second flow rate control to start the merger of the pressurized oil. The second flow rate control is such that the discharge amount of the merged pressurized oil varies in proportion to the rate of the operation signal input. Thus, by performing the merger so that the discharge amount of the merged pressurized oil various proportionally, a possible extreme variation in the torque of the engine is inhibited. Consequently, possible noise from the engine can be inhibited, and the fuel consumption can be improved. Furthermore, since the merger of the pressurized oil is started after the engine rotation speed has been increased to the second engine rotation speed, the engine is prevented from being stalled, enabling the merger to be smoothly started. Furthermore, the flow of the pressurized oil to be discharged can be stabilized, thus allowing the operation of the crane to be stabilized.

Moreover, when the rate of the operation signal input is in the third region, the discharge flow rate control means performs the third flow rate control in which the flow rate control valve is fully open to allow the main hydraulic pump and the sub hydraulic pump to discharge the possible maximum amount of pressurized oil. The engine rotation speed control means correspondingly performs the third rotation speed control to increase the rotation speed of the engine in proportion to the rate of the operation signal input to the third engine rotation speed higher than the second engine rotation speed. Thus, even after the flow rate control valve is fully opened, a possible extreme variation in the torque of the engine is inhibited. Consequently, possible noise from the engine can be inhibited, and the fuel consumption can be improved.

Here, in the pressurized-oil supply amount control device according to the first embodiment, in the controller, the engine rotation speed control means and the discharge flow rate control means preferably cooperatively perform control such that a total flow rate of the pressurized oil supplied to the control valve increases in proportion to the rate of the operation signal input in all the regions. In this configuration, the total flow rate of the pressurized oil supplied to the control valve is increased in proportion to the rate of the operation signal input in all the regions. Consequently, the flow of the pressurized oil to be discharged is stabilized. Thus, possible noise from the engine can be more suitably inhibited, and the fuel consumption can further be improved. Furthermore, the operation of the crane can be stabilized.

Furthermore, in the pressurized-oil supply amount control device according to the first embodiment, the maximum discharge amount of the main hydraulic pump is preferably set to a value smaller than the maximum discharge amount of the sub hydraulic pump. This configuration is more suitable for reducing a torque load on the engine when the engine rotation speed and the rotating torque are low. Moreover, the maximum discharge amount of the main hydraulic pump is preferably set to a necessary and sufficient value for an inching operation. This configuration is suitable for reducing the torque load when the engine rotation speed and the rotating torque are low.

Additionally, a second embodiment provides a pressurized-oil supply amount control device for controlling a supply amount of pressurized oil supplied to a crane mounted on a vehicle. The pressurized-oil supply amount control device comprises a main hydraulic pump and a sub hydraulic pump simultaneously driven by an engine of the vehicle, a flow rate control valve adjusting the flow rate of the pressurized oil discharged from the sub hydraulic pump to a desired value and a controller individually controlling rotation speed of the engine and the flow rate control valve in response to an operation input to the crane. The pressurized-oil supply amount control device merges pressurized oil discharged from the main hydraulic pump with pressurized oil adjusted by the flow rate control valve and supplying the merged pressurized oil to a control valve used to drive the crane. A plurality of relationships between the operation input to the crane and both the rotation speed of the engine and predetermined flow rate of the pressurized oil set by the flow rate control valve are set for the controller, a desired relationship of the set plurality of relationships is selectable, and the controller individually controls the rotation speed of the engine and the predetermined flow rate of the pressurized oil set by the flow rate control valve based on the operation input to the crane and the selected desired relationship.

According to the pressurized-oil supply amount control device according to the second embodiment, the rotation speed of the vehicle engine and the predetermined flow rate of the pressurized oil set by the flow rate control valve can be individually controlled. Moreover, the plurality of relationships are set in order to allow the rotation speed of the engine and the predetermined flow rate of the pressurized oil set by the flow rate control valve to be individually controlled. The desired one of the plurality of relationships is selectable. Thus, the engine rotation speed and the flow rate control valve can be optimally controlled, for example, according to the engine characteristics of the vehicle on which the crane is mounted. Thus, if the pressurized-oil supply amount control device is applied to, for example, a vehicle that only needs a lower engine rotation speed to generate a rotating torque at which the main hydraulic pump and the sub hydraulic pump can be simultaneously driven to discharge pressurized oil of the rated pressure, more energy can be saved, and possible noise can be more drastically reduced.

Here, in the pressurized-oil supply amount control device according to the first or second embodiment, the control valve is of a stack type and comprises a plurality of directional control valves based on an indirect driving scheme to drive respective actuators for the crane, a flow rate control valve adjusting the flow rate of the pressurized oil discharged from the sub hydraulic pump and merging the pressurized oil from the sub hydraulic pump with the pressurized oil discharged from the main hydraulic pump to feed the merged pressurized oil to the plurality of directional control valves, two unload relief valves interposed between the main hydraulic pump and the plurality of directional control valves and between the sub hydraulic pump and the plurality of directional control valves, respectively, and a pressure reducing valve and a back pressure valve provided so as to acquire pilot oil required to drive the plurality of directional control valves, only from the main hydraulic pump, the directional control valves, the flow rate control valve, the unload relief valves, the pressure reducing valve and back pressure valve being stacked so as to make up the stack type.

When the control valve is configured as described above, the plurality of directional control valves, the flow rate control valve, the unload relief valves, the pressure reducing valve and back pressure valve, used to obtain the pilot oil, are stacked so as to make up the stack type control valve. Thus, required space can be saved, and the device can be easily assembled.

In the stack type control valve, the two unload relief valves are interposed in a line between the main hydraulic pump and the plurality of directional control valves and in a line between the sub hydraulic pump and the plurality of directional control valves. Thus, operating the two unload relief valves allows the pressurized oil from each of the pumps to be returned to a tank without passing the pressurized oil through the directional control valves. Therefore, the crane can be brought to an emergency stop, for example, in an emergency.

Furthermore, the stack type control valve includes the pressure reducing valve and back pressure valve, used to obtain the pilot oil required to drive the directional control valves based on the indirect driving scheme. Thus, for example, the operation of bringing the crane to an emergency stop in an emergency can be performed by remote control (radio control). Moreover, the pressure reducing valve and back pressure valve are provided so as to acquire the pilot oil required to drive the plurality of directional control valves, only from the main hydraulic pump. Thus, compared to a configuration in which the pressure reducing valve and back pressure valve are provided in a line following a position where the main hydraulic pump and the sub hydraulic pump are merged together, the present control valve enables a possible rise in oil temperature to be inhibited.

For example, in the pressurized-oil supply amount control device according to the first embodiment, the flow rate control valve is an arrangement for merging the pressurized oil from the sub hydraulic pump with the pressurized oil from the main hydraulic pump. On the other hand, a vehicle-mounted crane of this kind generally includes an overload preventing device controllably setting the crane in a desired condition according to a load factor for the crane. A known overload preventing device of this kind has a separate flow rate control valve controlling the flow rate of pressurized oil supplied to each of the directional control valves, used to drive the crane, according to the load factor for the crane (see, for example, Japanese Patent Laid-Open No. 9-216790). According to the technique described in Japanese Patent Laid-Open No. 9-216790, the crane can be controllably set in the desired condition according to the load factor for the crane.

Thus, it is contemplated that the technique described in Japanese Patent Laid-Open No. 9-216790 is incorporated into the pressurized-oil supply amount control device according to the first embodiment. However, when these techniques are simply combined together, the resulting configuration includes the flow rate control valve for the merger of the dual pump and the flow rate control valve for controlling the flow rate according to the load factor. Consequently, the resulting configuration still has room for improvement in terms of simplification of the control device and cost reduction.

Thus, a third embodiment has been made in view of this problem. An object of the third embodiment is to provide a pressurized-oil supply amount control device with a dual pump system which device includes a flow rate control valve that can be used both for merger and for controlling the flow rate according to the load factor.

That is, the third embodiment provides a pressurized-oil supply amount control device for controlling a supply amount of pressurized oil supplied to a crane mounted on a vehicle. The pressurized-oil supply amount control device comprises a main hydraulic pump and a sub hydraulic pump simultaneously driven by an engine of the vehicle, a flow rate control valve adjusting the flow rate of the pressurized oil discharged from the sub hydraulic pump to a desired value, a main hydraulic pump unload valve and a sub hydraulic pump unload valve capable of bypassing pressurized oil discharged from the main hydraulic pump and the sub hydraulic pump to a tank and a controller capable of controlling rotation speed of the engine and the flow rate control valve in response to an operation signal to the crane. The pressurized-oil supply amount control device merges the pressurized oil discharged from the main hydraulic pump with the pressurized oil from the sub hydraulic pump adjusted by the flow rate control valve and supplies the merged pressurized oil to each directional control valve used to drive the crane. In addition to the operation signal to the crane, a load signal corresponding to a load factor for the crane is input to the controller, and the controller controls the flow rate control valve based on the input operation signal, and controls the flow rate control valve or operates each of the unload valves based on the input load signal so that flow rate of the pressurized oil discharged from the sub hydraulic pump is reduced when the input load signal is large, as compared to a case where the load signal is small.

According to the pressurized-oil supply amount control device according to the third embodiment, the load signal according to the load factor for the crane and the operation signal to the crane are each input to the controller. The flow rate control valve is controlled based on the load signal and the operation signal. Thus, the single flow rate control valve can be used both to control the flow rate of the pressurized oil to be merged and to control the flow rate according to the load factor. The controller gives priority to the load signal corresponding to the load factor for the crane, over the operation signal in controlling the single flow rate control valve. Consequently, the controller can reliably set the flow rate in the desired condition according to the load factor for the crane.

Here, in the pressurized-oil supply amount control device according to the third embodiment, when the input load signal is within a first range in which the signal is smaller than a first predetermined value, the flow rate control valve is controlled based only on the operation signal to the crane. When the input load signal is within a second range in which the signal exceeds the first predetermined value and is smaller than a second predetermined value larger than the first predetermined value, the flow rate control valve is controlled such that the flow rate of the pressurized oil discharged from the sub hydraulic pump is reduced with increasing load signal, and is controlled based on the operation signal. When the input load signal is within a third range in which the signal exceeds the second predetermined value and is smaller than a third predetermined value larger than the second predetermined value, the flow rate control valve is controlled so as to be fully closed. When the input load signal is within a fourth range in which the signal exceeds the third predetermined value, each of the unload valves is operated to bypass the pressurized oil from the main hydraulic pump and the sub hydraulic pump to the tank.

In this configuration, the four ranges are set according to the load factor for the crane. This is suitable for controlling the device to the desired condition according to the load factor for the crane.

That is, for example, in the first range in which the load factor is relatively low, the flow rate control valve is controlled based only on the operation signal to the crane. Thus, a quick operation can be performed. Furthermore, for example, in the second range in which the load factor is moderate, the flow rate control valve is controlled such that the flow rate of the pressurized oil discharged from the sub hydraulic pump is reduced with increasing load signal. Thus, the crane can be operated at a speed corresponding to the level of the load factor. Moreover, for example, in the third range in which the load factor is relatively high, the flow rate control valve is controlled so as to be fully closed. Thus, the crane can be operated at a low speed equivalent to that during a creeping speed operation. Furthermore, in the fourth range, the operation of the crane can be stalled by operating the unload relief valve. This is suitable for controlling the crane to the desired condition.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
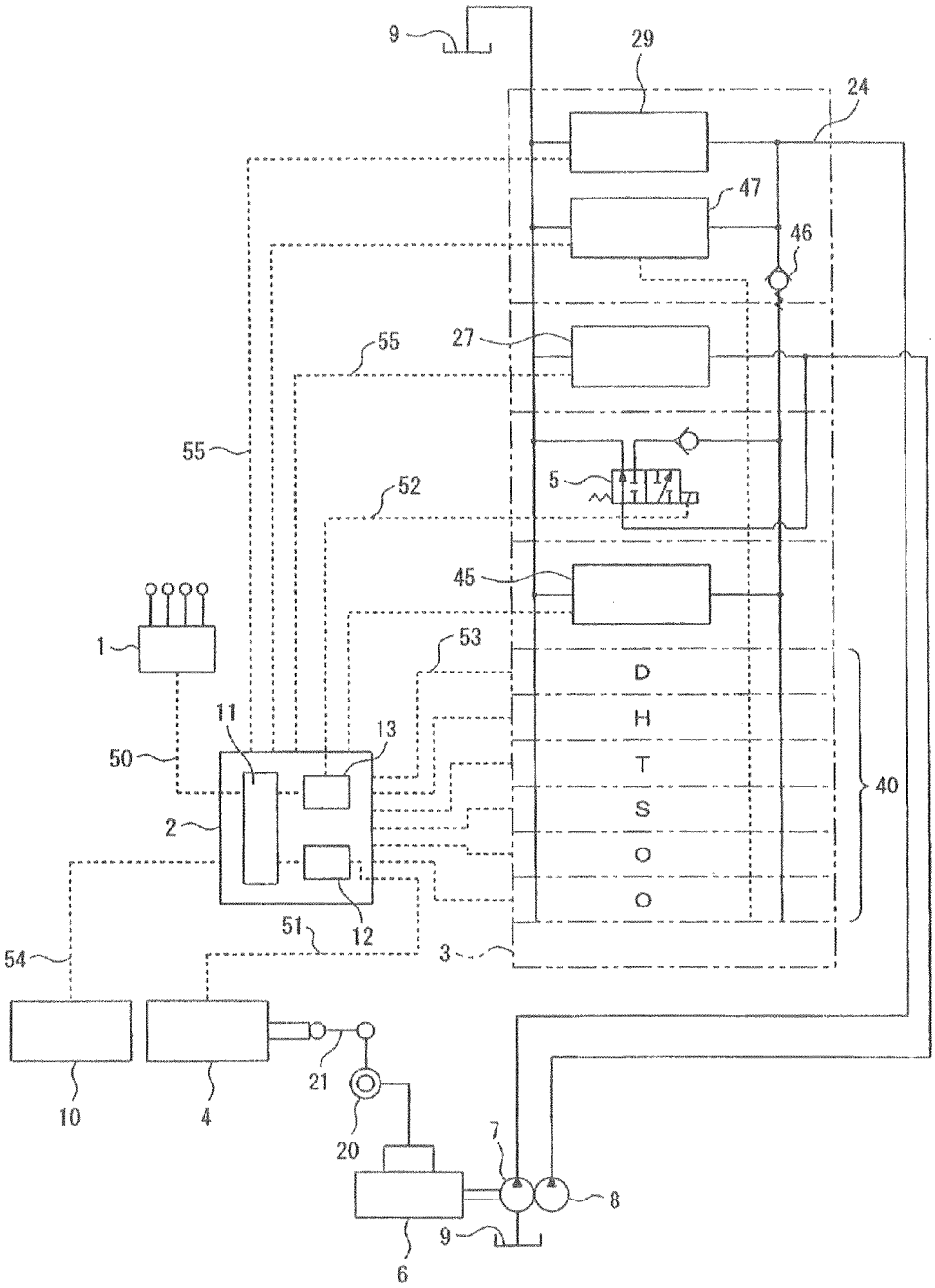
FIG. 1 is a diagram illustrating a first embodiment of a hydraulic circuit including a pressurized-oil supply amount control circuit for a vehicle-mounted crane according to the present invention.

As described above, the first and second embodiment provide the pressurized-oil supply amount control device for the vehicle-mounted crane which has the dual pump system and which is capable of further inhibiting possible noise from the engine and improving fuel consumption. Furthermore, the third embodiment provides the pressurized-oil supply amount control device having the dual pump system and which allows the flow rate control valve to be used both for the merger and for controlling the flow rate according to the load factor.

A first embodiment of a pressurized-oil supply amount control device for a vehicle-mounted crane according to the present invention will be described below referring appropriately to the drawings. In the description below, arrangements in the first embodiment which are similar to those in the conventional example are denoted by the same reference numerals.

FIG. 1 is a diagram illustrating a hydraulic circuit including the pressurized-oil supply amount control device for the vehicle-mounted crane according to the present invention.

As shown in FIG. 1, the pressurized-oil supply amount control device for the vehicle-mounted crane (hereinafter referred to as the "control device") has an operation input device 1 via which an operator inputs a desired operation signal input. The operation input device 1 enables an operation signal corresponding to the operator's operation to be output to a controller 2 via a signal line 50 (the controller 2 will be described below in detail).

The control device includes a main hydraulic pump 7 and a sub hydraulic pump 8 which are simultaneously driven by an engine 6. The main hydraulic pump 7 is connected, on a discharge side thereof, directly to a control valve 3 via a main circuit 24 of a hydraulic circuit.

The sub hydraulic pump 8 is connected to the main circuit 24 via a flow rate control valve 5. The sub hydraulic pump 8 is configured to merge pressurized oil discharged from the main hydraulic pump 7 with pressurized oil from the sub hydraulic pump 8 adjusted by the flow rate control valve 5 and to supply the merged pressurized oil to the control valve 3. Here, the discharge amount of the main hydraulic pump 7 is smaller than that of the sub hydraulic pump 8. In particular, the discharge amount of the main hydraulic pump 7 according to the present embodiment is set to a necessary and sufficient value for an inching operation of the crane.

The flow rate control valve 5 is connected to the controller 2 via a control line 52. Based on a control signal from the controller 2, the flow rate control valve 5 enables the flow rate of the pressurized oil discharged from the sub hydraulic pump 8 to be adjusted to a predetermined value.

Directional control valves 40 for respective actuator (not shown in the drawings) for the crane is provided in the control valve 3 to drive the actuators. Each of the directional control valves 40 is connected to the controller 2 via a control line 53 to perform an operation of switching an oil path based on a control signal from the controller 2 corresponding to the operation signal.

The control valve will be described below in further detail.

As shown in FIG. 1, the control valve 3 for the vehicle-mounted crane has the plurality of directional control valves 40 based on an indirect driving scheme. The control valve 3 is configured as a stack type such that on top of the plurality of directional control valves 40, a pressure compensating valve 45, the flow rate control valve 5, an unload relief valve 27, a pressure reducing valve 47, a back pressure valve 46, and an unload relief valve 29 are stacked in this order so that the pressure compensating valve 45 is located closest to the plurality of directional control valves 40.

Here, the unload relief valve 29, pressure reducing valve 47, back pressure valve 46, and pressure compensating valve 45, provided in the control valve 3, are connected, on the discharge side thereof, to the main hydraulic pump 7 in this order, as shown in FIG. 1. The pressure reducing valve 47 and the back pressure valve 46 are provided in order to acquire pilot oil required to drive the plurality of the directional control valves 40, only from the main hydraulic pump 7. Thus, the pilot oil required for each of the directional control valves 40 is covered only by the pressurized oil from the main hydraulic pump 7.

The flow rate control valve 5 and the unload relief valve 27 are connected to the discharge side of the sub hydraulic pump 8. The flow rate control valve 5 allows the flow rate of the pressurized oil discharged from the sub hydraulic pump 8 to be adjusted to a desired value. The flow rate control valve 5 also serves to merge the pressurized oil discharged from the sub hydraulic pump 8 with the pressurized oil discharged from the main hydraulic pump 7 and to feed the merged pressurized oil to the plurality of directional control valves 40. The control valve 3 actuates the two unload relief valves 27, 29 to enable the pressurized oil from the pumps 7, 8 to be returned to a tank 9 without passing through the directional control valves 40. Thus, for example, the crane can be brought to an emergency stop if needed.

Moreover, as shown in FIG. 1, the control device includes an accelerator cylinder 4 and a governor 20. The accelerator cylinder 4 and the governor 20 are coupled together via a first link 21. The accelerator cylinder 4 is also connected to the controller 2 via a signal line 51. The accelerator cylinder 4 is driven based on a control signal from the controller 2 corresponding to the operation signal.

In the control device, in response to the operation of the accelerator cylinder 4, the governor 20 adjusts the amount of fuel injected into the engine 6 to enable the rotation speed of the engine to be controlled to a desired value. That is, the present embodiment does not have the second link 22 illustrated above. The rotation speed of the engine 6 and the predetermined flow rate of the pressurized oil set by the flow rate control valve 5 can be individually controlled by the controller 2.

Here, as shown in FIG. 1, the controller 2 includes a control pressurized-oil supply amount managing section 11 that manages the supply amount of the pressurized oil according to the operation signal input to the operation input device 1, an engine rotation speed control section 12 which, in response to an instruction from the control pressurized-oil supply amount managing section 11, outputs a corresponding control signal to the accelerator cylinder 4, and a discharge flow amount control section 13 which, in response to an instruction from the control pressurized-oil supply amount managing section 11, outputs a corresponding control signal to the flow rate control valve 5. The controller 2 can execute a pressurized-oil supply amount control process of controlling the rotation speed of the engine 6 and the flow rate of the pressurized oil set by the flow rate control valve 5, according to the rate of the operation signal input to the crane. The engine rotation speed control section 12 corresponds to the above-described engine rotation speed control means. The discharge flow rate control section 13 corresponds to the above-described discharge flow rate control means.

More specifically, the controller 2 includes a CPU that executes calculations for the pressurized-oil supply amount control process and controls the whole system of the control device, based on a predetermined control program, a ROM that pre-stores the control program for the CPU and the like in a predetermined region, a RAM that stores data read from the ROM or the like and calculation results required during calculations executed by the CPU, and an I/F (interface) serving as a medium for data inputs from and data outputs to external devices including the above-described operation input device 1, the control valve 3, the accelerator cylinder 4, and the flow rate control valve 5 (none of the CPU, ROM, RAM and I/F are shown in the drawings).

The I/F of the controller 2 is connected to the external devices via respective signal lines (reference numerals 50 to 55 shown by dashed lines in FIG. 1) such as buses through which data is transmitted, so as to transmit and receive data such as operation and control signals to and from the external devices. Thus, a control signal corresponding to an operation signal input via the operation input device 1 can be output to each of the control valve 3, the accelerator cylinder 4, and the flow rate control valve 5.

Here, a program executing the above-described pressurized-oil supply amount control process is stored in a predetermined region of the ROM so as to be appropriately referenceable, in such a format as enables required calculation results to be derived during calculations in the program. Furthermore, a predetermined control function is stored in the ROM as table data. The predetermined control function is referenced during the pressurized-oil supply amount control process executed by the controller 2. That is, in the pressurized-oil supply amount control process executed by the controller 2, according to the operation signal input from the operation input device 1, control signals output to the accelerator cylinder 4 and the flow rate control valve 5 are individually set based on the above-described predetermined control function.

The predetermined control function and the corresponding pressurized-oil supply amount control process will be described below in further detail.

Figure 2:
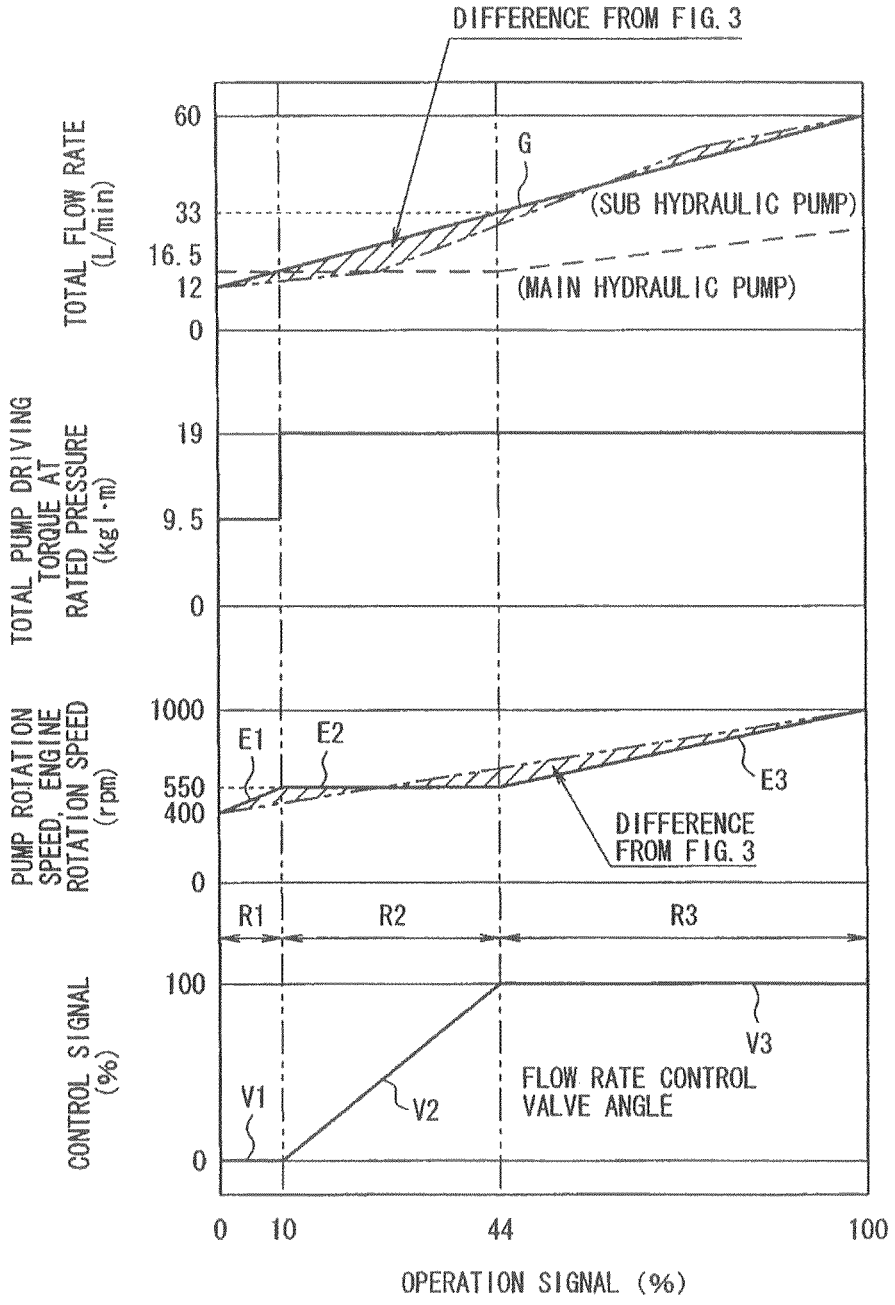
FIG. 2 is a diagram illustrating a predetermined control function (a control map used for a pressurized-oil supply amount control process) applied to the control device shown in FIG. 1.

FIG. 2 is a diagram illustrating the predetermined control function (a control map used for the pressurized-oil supply amount control process) applied to the control device.

The graphs shown in FIG. 2 illustrate the above-described control function (control map) that can be referenced as table data. The lowermost graph shows the angle of the flow rate control valve 5. The engine rotation speed, the total pump driving torque at a rated pressure, the total flow rate G of the main and sub hydraulic pumps 7, 8 are shown above the lowermost graph in this order from bottom to top. In connection with the numerical values in the graphs shown in FIG. 2, the following are assumed: the displacement of each of the main hydraulic pump 7 and the sub hydraulic pump 8 is 30 cm3/rev, the idling rotation speed of the engine is 400 rpm, a rated rotation speed is 1,000 rpm, an engine rotation speed offering a necessary and sufficient rotating torque for preventing the possible insufficiency of the rotating torque is 550 rpm, the speed reduction ratio of the engine and the pump is 1 (engine rotation speed=pump rotation speed), and the rated pressure is 20 MPa.

A driving torque T for the hydraulic pumps is calculated by Expression 1 shown below. A discharge flow rate Q is calculated by Expression 2 shown below.

$$T=p*q/2\pi \quad \text{(Expression 1)}$$

$$Q=q*N \quad \text{(Expression 2)}$$

where P: discharge pressure, q: pump displacement, and N: pump rotation speed.

Here, three regions are set for the control pressurized-oil supply amount managing section 11 in the controller 2 to allow control corresponding to the rate of the operation signal input to be performed. That is, as shown in FIG. 2, in the present embodiment, a first region R1, a second region R2, and a third region R3 are set; in the first region R1, the rate of the operation signal input is lower than 10% (first rate), and in the second region R2, the rate of the operation signal input is at least 10% and lower than 44% (second rate), and in the third region R3, the rate of the operation signal input is at least 44%.

Moreover, the discharge flow rate control section 13 is configured to be able to perform three types of control corresponding to the three regions R1, R2, and R3. That is, as shown in FIG. 2, the discharge flow rate control section 13 includes first flow rate control V1, second flow rate control V2, and third flow rate control V3.

Specifically, in the first flow rate control V1, the discharge flow rate control section 13 performs control such that the flow rate control valve 5 is fully opened to supply only the pressurized oil from the main hydraulic pump 7 to the control valve 3. In the second flow rate control V2, the discharge flow rate control section 13 performs control such that the pressurized oil from the sub hydraulic pump 8 is merged with the pressurized oil discharged from the main hydraulic pump 8 so that the discharge amount of the merged pressurized oil varies in proportion to the rate of the operation signal input to supply to the control valve 3. Moreover, in the third flow rate control V3, the discharge flow rate control section 13 performs control such that the flow rate control valve 5 is fully opened to supply the control valve 3 with a possible maximum amount of pressurized oil discharged from the main hydraulic pump 7 and the sub hydraulic pump 8.

Furthermore, the engine rotation speed control section 12 is also configured to be able to execute three types of control corresponding to the above-described three regions R1, R2, R3. That is, as shown in FIG. 2, the engine rotation speed control section 12 includes first rotation speed control E1, second rotation speed control E2, and third rotation speed control E3.

Specifically, in the first rotation speed control E1, the engine rotation speed control section 12 performs control such that the rotation speed of the engine 6 varies in proportion to the rate of the operation signal input from an idling rotation speed (400 rpm) to 550 rpm (second engine rotation speed), corresponding to a necessary and sufficient torque for preventing the possible insufficiency of the rotating torque of the engine 6. In the second rotation speed control E2, the engine rotation speed control section 12 performs control such that the rotation speed of the engine 6 is maintained at 550 rpm, the second engine rotation speed. In the third rotation speed control E3, the engine rotation speed control section 12 increases the rotation speed of the engine 6 in proportion to the rate of the operation signal input from 550 rpm, the second engine rotation speed, to a third engine rotation speed (1,000 rpm) higher than the second engine rotation speed.

In the first region R1, the engine rotation speed control section 12 performs the first rotation speed control E1. The discharge flow rate control section 13 correspondingly performs the first flow rate control V1. In the second region R2, the engine rotation speed control section 12 performs the second rotation speed control E2. The discharge flow rate control section 13 correspondingly performs the second flow rate control V2. In the second region R3, the engine rotation speed control section 12 performs the third rotation speed control E3. The discharge flow rate control section 13 correspondingly performs the third flow rate control V3.

The controller 2 accelerates an increase in the rotation speed of the engine 6 up to 550 rpm, and once the rotation speed reaches 550 rpm (second engine rotation speed), maintains the rotation speed. Then, the controller 2 starts opening the flow rate control valve 5 to merge the pressurized oil from the main hydraulic pump 7 with the pressurized oil from the sub hydraulic pump 8. Thus, the total flow rate G increases proportionally. Then, once the flow rate control valve 5 is fully opened, increasing the rotation speed of the engine 6 is resumed, with the total flow rate G proportionally increased. In the controller 2, the engine rotation speed control section 12 and the discharge flow rate control section 13 cooperatively perform control such that the total flow rate G of the pressurized oil supplied to the control valve 3 increases linearly, that is, the total flow rate G increase in proportion to the rate of the operation signal input in all of the regions R1 to R3 as shown in FIG. 2.

Now, the effects and advantages of the pressurized-oil supply amount control device for the vehicle-mounted crane according to the first embodiment will be described.

As described above, according to the control device of the first embodiment, when the rate of the operation signal input is in the first region R1, the controller 2 allows the discharge flow rate control section 13 to perform the first flow rate control V1, in which the pressure oil is discharged only from the main hydraulic pump 7, while allowing the engine rotation speed control section 12 to correspondingly perform the first rotation speed control E1, in which the rotation speed of the engine 6 increases in proportion to the rate of the operation signal input from the idling rotation speed (400 rpm) to 550 rpm (second engine rotation speed), corresponding to the necessary and sufficient torque for preventing the possible insufficiency of the rotating torque of the engine 6. Thus, when only a small amount of pressurized oil is required as in the case of, for example, an inching operation, the engine rotation is reduced, thus enabling energy saving and noise reduction.

In the controller 2, when the rate of the operation signal input is in the second region R2, the engine rotation speed control section 12 performs the second rotation speed control E2, in which the rotation speed is maintained at 550 rpm, which is the second engine rotation speed at which the possible insufficiency of the rotating torque of the engine 6 is prevented, and with the rotation speed increased up to the second engine rotation speed, the discharge flow rate control section 13 correspondingly performs the second flow rate control V2, in which the merger of the pressurized oil is started. In the second flow rate control V2, the merger of the pressurized oil is performed such that the total flow rate G of the merged pressurized oil varies proportionally. Thus, a possible extreme variation in the torque of the engine 6 is inhibited. Consequently, possible noise from the engine 6 can be inhibited, and power consumption can be improved. Furthermore, the merger of the pressurized oil is started after the rotation speed has been increased up to the necessary and sufficient, second engine rotation speed (550 rpm) at which the possible insufficiency of the rotating torque of the engine 6 is prevented. This prevents the engine from being stalled, enabling the merger to be smoothly started. Furthermore, the flow of the pressurized oil to be discharged can be stabilized, allowing the operation of the crane to be stabilized.

In the controller 2, when the rate of the operation signal input is in the third region R3, the discharge flow rate control section 13 performs the third flow rate control V3, in which the flow rate control valve 5 is fully opened to discharge the possible maximum amount of pressurized oil from the main hydraulic pump 7 and the sub hydraulic pump 8. The engine rotation speed control section 12 correspondingly performs the third rotation speed control E3, in which the rotation speed is increased in proportion to the rate of the operation signal input up to the third engine rotation speed (1,000 rpm), which is higher than the second engine rotation speed. Thus, even after the flow rate control valve 5 is fully opened, a possible extreme variation in the torque of the engine 6 is inhibited. Consequently, possible noise from the engine 6 can be inhibited, and power consumption can be improved.

Furthermore, in the controller 2, the engine rotation speed control section 12 and the discharge flow rate control section 13 cooperatively perform control such that the total flow rate G of the pressurized oil supplied to the control valve 3 is increased in proportion to the rate of the operation signal input in all of the regions R1 to R3. Thus, the flow of the pressurized oil to be discharged is stabilized. Consequently, possible noise from the engine 6 can be inhibited, and power consumption can be improved. Additionally, the operation of the crane can be more properly stabilized.

Figure 3:
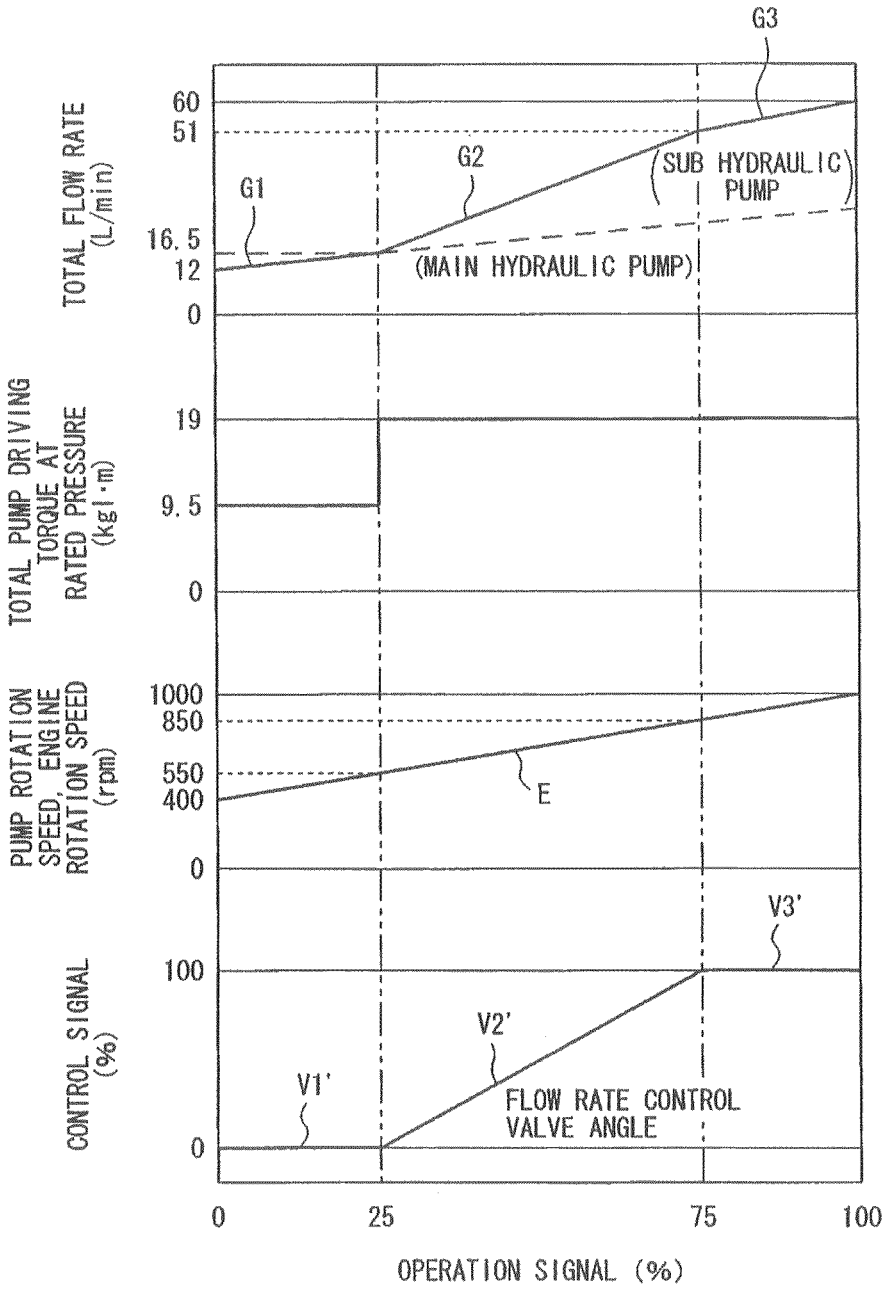
FIG. 3 is a diagram showing another control function (a control map used for the pressurized-oil supply amount control process) for comparison.

For example, for comparison with the above-described example shown in FIG. 3, another control function is shown. The displacement of each of the pumps and the rated rotation speed of the engine are the same for the above-described predetermined control function according to the present invention and for the another control function.

As shown in FIG. 3, this example of control function is assumed to relate to the single rotation speed control E in which the rotation speed of the engine 6 increases in proportion to the operation signal input from 400 rpm to 1,000 rpm. The rotation speed at which a torque is generated which allows the engine to be driven without, for example, being stalled even with the merger of the pressurized oil from the main hydraulic pump 7 with the pressurized oil from the sub hydraulic pump 8 is assumed to be 550 rpm as described above.

In this example, as shown in FIG. 3, when the rotation speed of the engine 6 decreases down to 550 rpm, that is, the operation signal input decreases down to 25%, the flow rate control valve 5 needs to be start opening, and the flow rate control valve 5 thus shifts from flow rate control V1' in which the flow rate control valve 5 is fully closed to flow rate control V2' in which the flow rate control valve 5 starts opening. A timing for flow control V3' at which the flow rate control valve 5 is fully opened can be optionally set. In the example shown in FIG. 2, the timing is set such that the flow rate control valve 5 is fully opened when the operation signal input is 75%. As a result, the total flow rate (discharge amount) of the pressurized oil supplied to the control valve 3 is as shown by a line plot including total flow rates G1, G2, G3 as shown in the top stage in FIG. 3.

Here, the graphs in FIGS. 2 and 3 are compared with each other. Since both the pump displacement and the rated rotation speed of the engine 6 are the same for the predetermined control function according to the present invention and for the another control function, the total flow rate of pressurized oil supplied in response to the operation signal input is similar. However, the predetermined control function according to the present invention shown in FIG. 2 allows control to be performed such that the merger of the pressurized oil from the sub hydraulic pump 8 is started early so that in the second region R2, the intermediate region for the operation signal, the rotation speed of the engine 6 is maintained. The resulting total flow rate (discharge amount) G increases linearly. Thus, compared to the other control function shown in FIG. 3, the present control function enables a general reduction in engine rotation speed. Correspondingly, compared to the other control function shown in FIG. 3, the present control function enables a further reduction in engine rotation speed in most of the operation regions.

In the vehicle-mounted crane having the dual pump system, the above-described control valve 3 allows required space to be saved and improves assembly capability. Moreover, even if the crane can be brought to an emergency stop and can also be remotely controlled, a possible increase in oil temperature can be inhibited.

That is, since the above-described control valve 3 is of the stack type in which the plurality of directional control valves 40, the flow rate control valve 5, the unload relief valves 27, 29, and the pressure reducing valve 47 and back pressure valve 46, serving to obtain the pilot oil, are stacked, the required space can be saved, and the assembly capability can be improved.

In the control valve 3, the two unload relief valves 29, 27 are interposed in the line between the main hydraulic pump 7 and the plurality of directional control valves 40 and in the line between the sub hydraulic pump 8 and the plurality of directional control valves 40, respectively. Thus, actuating the two unload relief valves 29, 27 allows the pressurized oil from the pumps 7, 8 to be returned to the tank 9 without passing through the directional control valves 40. Consequently, for example, the crane can be brought to an emergency stop in an emergency.

In the control valve 3, the plurality of directional control valves 40 are based on the indirect driving scheme. The control valve 3 thus includes the pressure reducing valve 47 and back pressure valve 46, used to obtain the pilot valve for the indirect driving scheme. Thus, the operation of bringing the crane to an emergency stop can be remotely controlled (radio controlled). Moreover, the pressure reducing valve 47 and the back pressure valve 46 are configured to acquire the required pilot oil only from the main hydraulic pump 7. Consequently, the present configuration enables a possible increase in oil temperature to be inhibited compared to a configuration in which the pressure reducing valve 47 and the back pressure valve 46 are provided in a line located after the position where the pressurized oil from the main hydraulic pump 7 is merged with the pressurized oil from the sub hydraulic pump 8.

Now, a second embodiment of the pressurized-oil supply amount control device for the vehicle-mounted crane according to the present invention will be described. In the description below, arrangements in the second embodiment which are similar to those in the first embodiment are denoted by the same reference numerals. Description of these arrangements is appropriately omitted, and arrangements different from those of the first embodiment will be described in further detail.

In the second embodiment, a plurality of control functions are stored in a ROM in a controller 2 as table data. On the other hand, an operation input device 1 has a selection switch (not shown in the drawings) used to select one of the plurality of control functions. One of the plurality of control functions can be individually selected in response to an operation signal provided by operating a selection switch on the operation input device 1. The selected desired control function is referenced for a predetermined pressurized-oil supply amount control process executed by the controller 2. That is, the pressurized-oil supply amount control process corresponding to the selected desired control function individually sets control signals output to an accelerator cylinder 4 and a flow rate control valve 5 by the controller 2 in response to an operation signal from the operation input device 1.

Specifically, two control functions as the above-described plurality of control functions, that is, a first control function and a second control function, are stored in a predetermined region in the ROM of the controller 2 according to the second embodiment so as to be appropriately referenceable, in such a format as enables required calculation results to be derived during calculations for the pressurized-oil supply amount control process. One of the plurality of control functions can be selected in response to an operation performed by the operator via the selection switch on the operation input device 1. One of the plurality of control functions can be appropriately selected according to the engine characteristics of the vehicle.

Each of the control functions is set such that the total discharge flow rate of the pressurized oil from the main hydraulic pump 7 and the sub hydraulic pump 8 varies in proportion to an operation signal corresponding to an operation input to the crane. The first control function differs from the second control function in the control balance between the accelerator cylinder 4 and the flow rate control valve 5. The first and second control functions will be described below in further detail.

Figure 4:
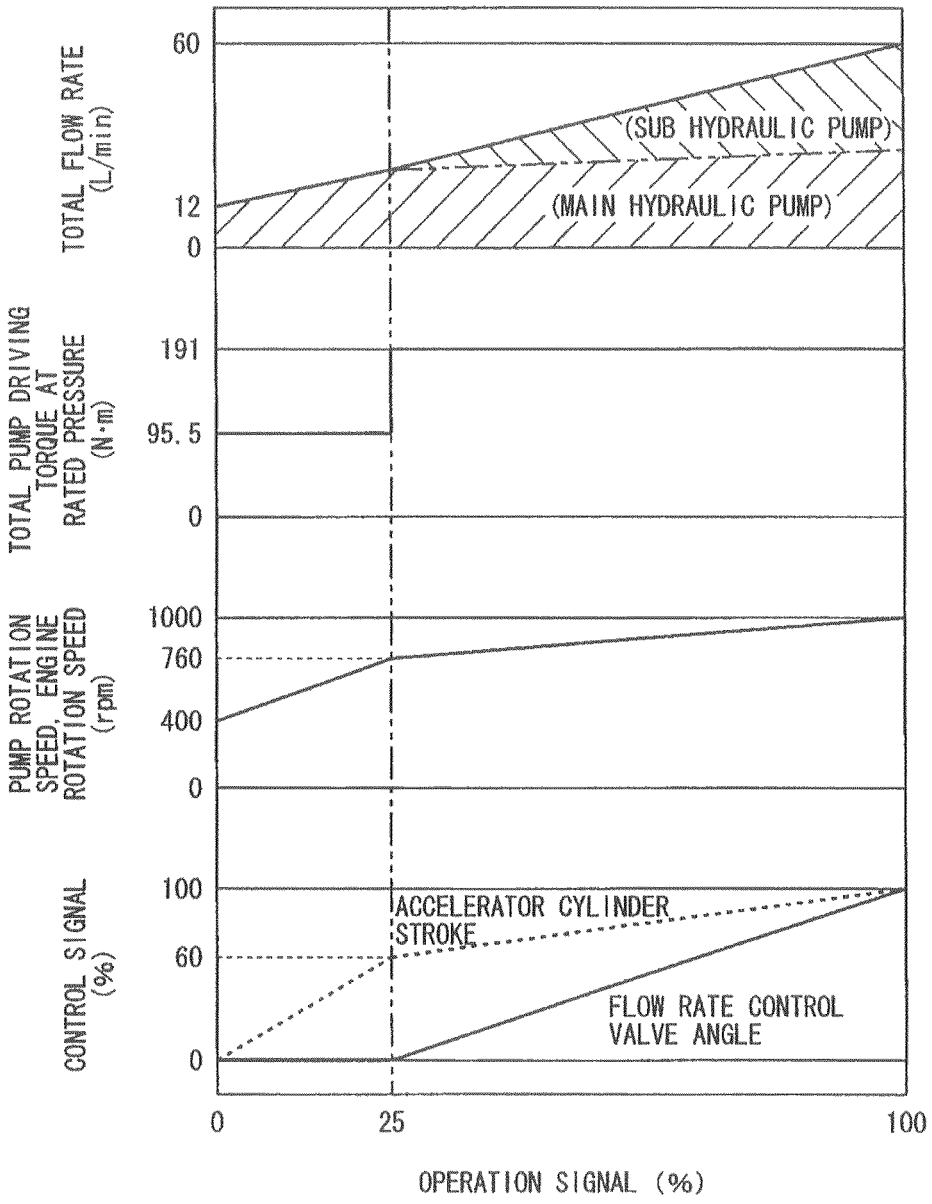
FIG. 4 is a diagram illustrating a first control function (a first control map used for the pressurized-oil supply amount control process) applied to a control device according to a second embodiment.

FIG. 4 is a diagram illustrating the first control function (a first control map used for the pressurized-oil supply amount control process) applied to the control device according to the second embodiment.

The lowermost graph in FIG. 4 illustrates the above-described first control function (control map) that can be referenced as table data. The engine rotation speed, the total pump driving torque at a rated pressure, the total flow rate of a main hydraulic pump and a sub hydraulic pump are shown above the lowermost graph in this order from bottom to top. In connection with the numerical values in the graphs shown in FIG. 4, the following are assumed: the displacement of each of the main hydraulic pump 7 and the sub hydraulic pump 8 is 30 cm3/rev, the idling rotation speed of the engine is 400 rpm, the rated rotation speed is 1,000 rpm, the speed reduction ratio of the engine and the pump is 1 (engine rotation speed=pump rotation speed), and the rated pressure is 20 MPa.

As shown in FIG. 4, the first control function is set such that in the above-described pressurized-oil supply amount control process, when the rate of the operation signal input is 25%, an accelerator cylinder stroke is 60%, allowing the flow rate control valve 5 to start opening. Furthermore, when the rate of the operation signal input is lower than 25%, only the pressurized oil from the main hydraulic pump 7 is supplied to the control valve 3. Moreover, when the rate of the operation signal input exceeds 25%, the flow rate control valve 5 starts opening to allow the merger of the pressurized oil from the sub hydraulic pump 8. Once the pressurized oil from the sub hydraulic pump 8 is merged with the pressurized oil from the main hydraulic pump 7, a load is imposed on the sub hydraulic pump 8. This increases a driving torque for the pump and thus a torque load on the engine 6.

Here, the engine rotation speed obtained when the rate of the operation signal input is 25% is calculated under the conditions assumed above. This rotation speed is between the idling rotation speed of 400 rpm and the rated rotation speed of 1,000 rpm, i.e., 60% of the rated rotation speed, namely, 760 rpm. That is, in the pressurized-oil supply amount control process based on the first control function, when the engine rotation speed is at least 760 rpm, the merger of the pressurized oil from the sub hydraulic pump 8 is started. This increases the torque load on the engine 6. Furthermore, the pump driving torque obtained at this time is sufficient for driving the main hydraulic pump 7 and the sub hydraulic pump 8. Although depending on a discharge pressure, the torque is equal to that obtained at the rated pressure of 20 MPa. That is, under the assumed conditions (rated pressure P=20 MPa, pump displacement q=30 cm3/rev+30 cm3/rev=60 cm3/rev), the torque is calculated to be 191 N·m. Thus, application of the first control function requires that the engine generates a rotating torque of 191 N·m at an engine rotation speed of at most 760 rpm.

However, if the engine exerts high power and can generate a rotating torque of 191 N·m at a lower engine rotation speed, the first control function increases the engine rotation speed more significantly than required.

Thus, the control device according to the second embodiment includes the second control function that allows the merger of the pressurized oil from the sub hydraulic pump 8 to be started at a lower engine rotation speed. The second control function can be selected according to the engine characteristics of the vehicle.

Figure 5:
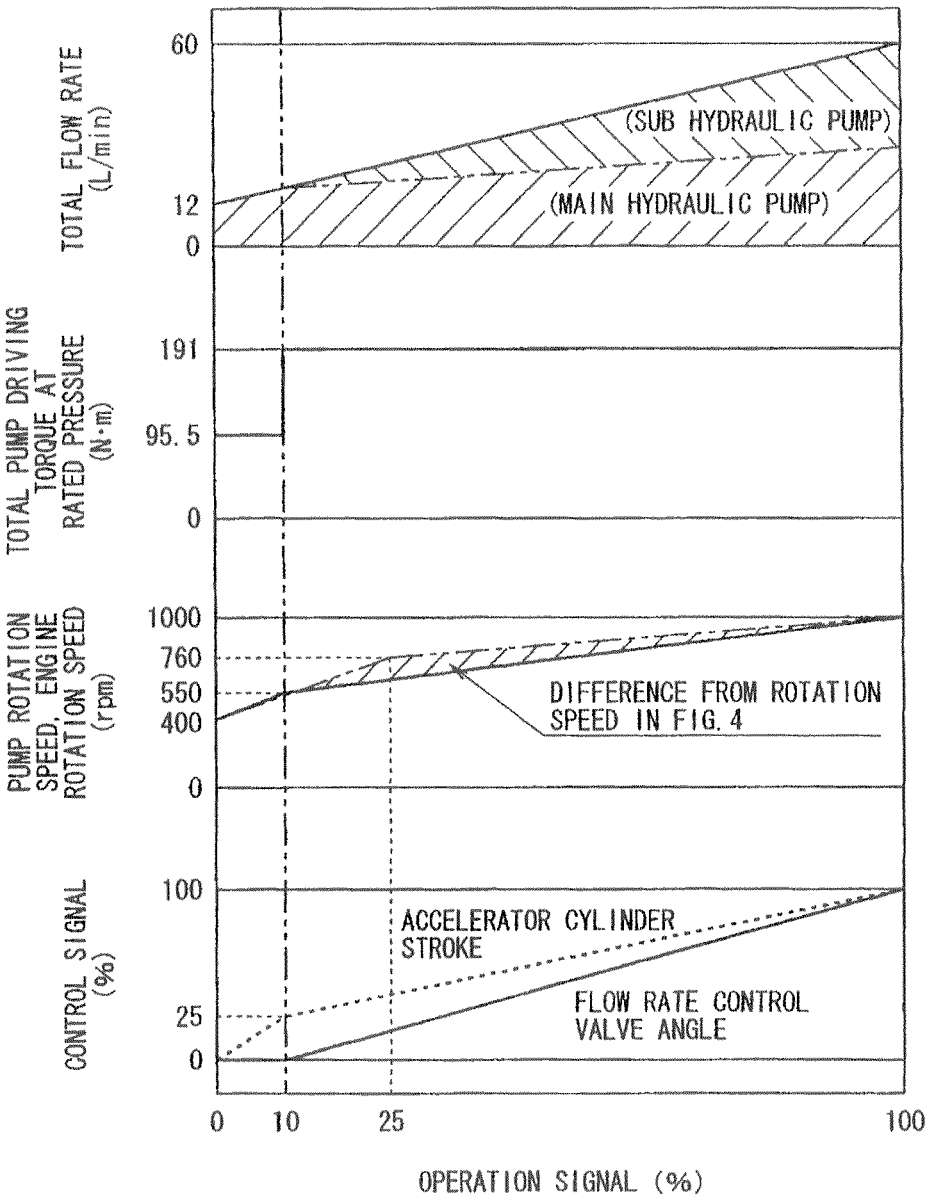
FIG. 5 is a diagram illustrating a second control function (a second control map used for the pressurized-oil supply amount control process) applied to the control device according to the second embodiment.

The second control function (control map) is shown in FIG. 5. For the second control function, the assumed conditions such as the pump displacement and the engine rotation number are similar to those for the first control function, shown in FIG. 4.

As shown in FIG. 5, the pressurized-oil supply amount control process based on the second control function is set such that when the rate of the operation signal input is 10%, the accelerator cylinder stroke is 25%, allowing the flow rate control valve 5 to start opening. For the second control function, when the engine rotation speed is calculated as in the case of the first control function, the engine rotation speed obtained when the rate of the operation signal input is 10% is determined to be 550 rpm. An engine rotation speed of at least 550 rpm allows the merger of the pressurized oil from the sub hydraulic pump 8 to be started. Thus, application of the second control function requires that the engine generates a rotating torque of 191 N·m at an engine rotation speed of at most 550 rpm.

Here, the graphs in FIG. 4 are compared with those in FIG. 5. Then, since the pump displacement and the rated rotation speed of the engine are the same for the first and second control functions, the total flow rate of pressurized oil supplied in response to the operation signal input is the same for the first and second control functions. However, for the second control function shown in FIG. 5, since the merger of the pressurized oil from the sub hydraulic pump 8 starts earlier, the engine rotation speed in the intermediate region of the operation signal, is lower than in the case of the first control signal. That is, for an engine that generates a rotating torque of 191 N·m at an engine rotation speed of 500 rpm, application of the pressurized-oil supply amount control process based on the second control function allows crane operations to be performed at a lower engine rotation speed.

Here, each of the above-described first and second control functions corresponds to the above described "relationship between the operation input to the crane and both the rotation speed of the engine and the predetermined flow rate of pressurized oil set by the flow rate control valve". The one of the above-described plurality of control functions which is appropriately selected according to the engine characteristics of the vehicle corresponds to the "desired one of the above-described set plurality of relationships".

As described above, in the control device according to the second embodiment, the controller 2 sets the plurality of different control functions (first and second control functions) in the form of table data. The pressurized-oil supply amount control process executed by the controller 2 enables the desired one of the plurality of control functions to be selected via the operation input device 1. Consequently, the appropriate control function can be selected according to the engine characteristics of the vehicle with the crane mounted thereon. This enables the optimization of the engine rotation speed and the control of the flow rate control valve 5, serving to control the flow rate of the pressurized oil from the sub hydraulic pump 8. Thus, if the control device is applied to, for example, a vehicle that only needs a lower engine rotation speed to generate a rotating torque at which the main hydraulic pump 7 and the sub hydraulic pump 8 can be simultaneously driven to discharge pressurized oil of the rated pressure, further energy saving and noise reduction can be achieved.

Now, a third embodiment of the pressurized-oil supply amount control device for the vehicle-mounted crane according to the present invention will be described. In the description below, arrangements in the third embodiment which are similar to those in the first embodiment are denoted by the same reference numerals. Description of these arrangements is appropriately omitted, and arrangements different from those of the first embodiment will be described in further detail.

Figure 6A:
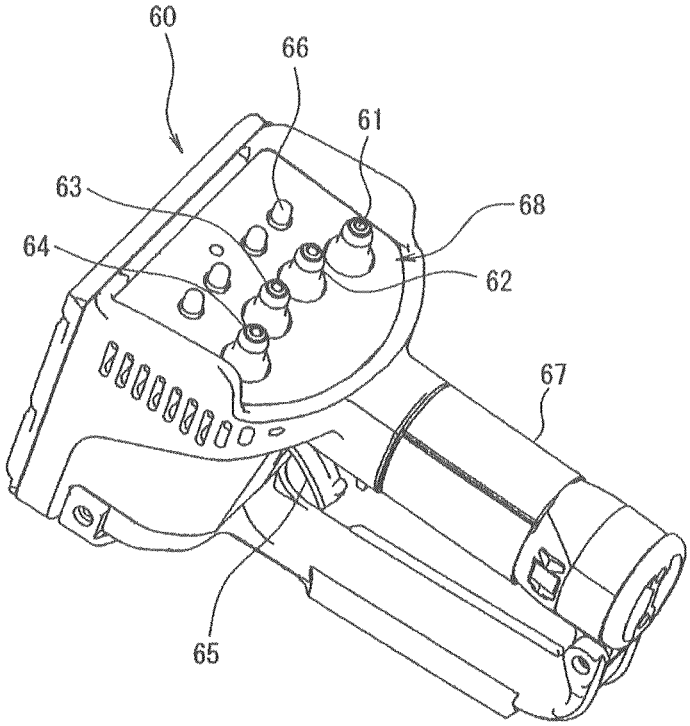
FIG. 6 is a diagram illustrating a radio controller for a vehicle-mounted crane according to the present invention, wherein FIG. 6(*a*) is a perspective view of the radio controller, and FIG. 6(*b*) is a side view of the radio controller.
Figure 6B:
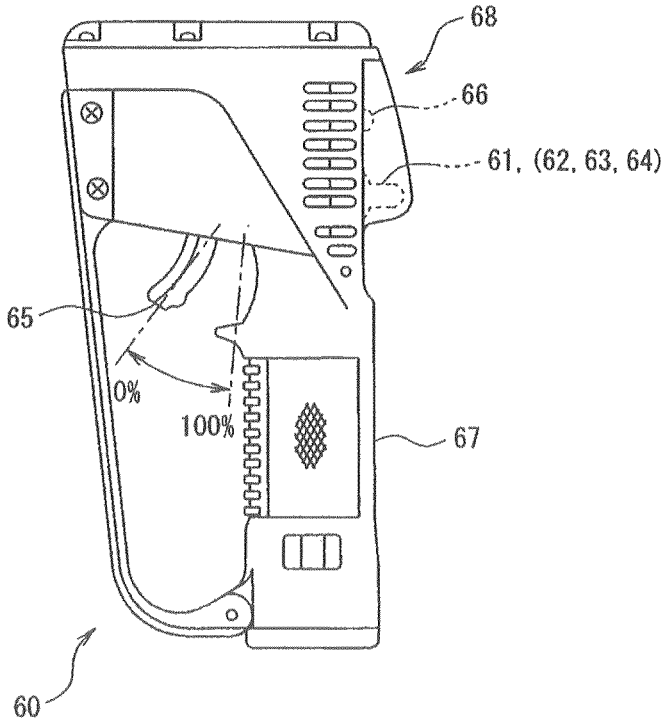

The vehicle-mounted crane according to the third embodiment includes a radio controller 60 that allows the crane to be operated by remote control (radio control). The radio controller 60 can transmit and receive operation signals and the like to and from the controller 2 via known radio communication means. The radio controller 60 will be described referring appropriately to FIG. 6. FIG. 6(*a*) is a perspective view of the radio controller. FIG. 6(*b*) is a side view of the radio controller.

As shown in FIG. 6, the radio controller 60 includes a grip section 67 and an operation section 68.

A boom raising and laying switch 61, a winch switch 62, and a boom expanding and contracting switch 63, a lateral turning switch 64, and the like are arranged on the operation section 68. The switches are configured to be able to transmit operation signals corresponding to the directional control valves 40 (denoted by reference numerals D to S in FIG. 1), used to drive the corresponding actuators. An inching button 66 is also located on the operation section 68 to allow the crane to perform an inching operation. The inching button 66 is configured to be able to transmit the corresponding operation signal to a controller 2. A speed lever 65 projects from the bottom surface of the operation section 68. As shown in FIG. 6(*b*), the speed lever 65 is a speed controller that enables the rate of the operation signal to the crane to be adjusted between 0% and 100%. According to the degree to which the speed lever 65 is pulled, the corresponding operation signal can be transmitted to the controller 2 to adjust the operation speed of the crane.

Here, the above-described controller 2 is configured to execute a pressurized-oil supply amount control process in which based on a load signal input to the controller 2 by an overload preventing device 10, the flow rate of the pressurized oil from a sub hydraulic pump 8 is reduced when an input load signal is large compared to when the load signal is small and in which a flow rate control valve 5 is controlled based on an operation signal input via the operation input device 1 or the radio controller 60 (hereinafter also referred to as the operation input device 1 or the like) according to the operator's operation. The above-described flow rate control valve 5 is of a proportional type in which the maximum operation amount of a spool thereof is appropriately limited according to the load signal. Limiting the maximum operation amount of the spool enables the flow rate of the pressurized oil discharged from the sub hydraulic pump 8 to be proportionally adjusted.

In the controller 2 according to the third embodiment, a program executing the pressurized-oil supply amount control process is stored in a predetermined region in a ROM so as to be appropriately referenceable, in such a format as enables required calculation results to be derived during calculations in the program. Furthermore, a predetermined control function is stored in the ROM as table data. The predetermined control function is referenced during the pressurized-oil supply amount control process executed by the controller 2. That is, the pressurized-oil supply amount control process executed by the controller 2 is such that according to the operation signal input from the operation input device 1 or the like and the load signal input by the overload preventing device 10, the control signals output to the accelerator cylinder 4 and the flow rate control valve 5 are individually set according to the predetermined control function.

Figure 7:
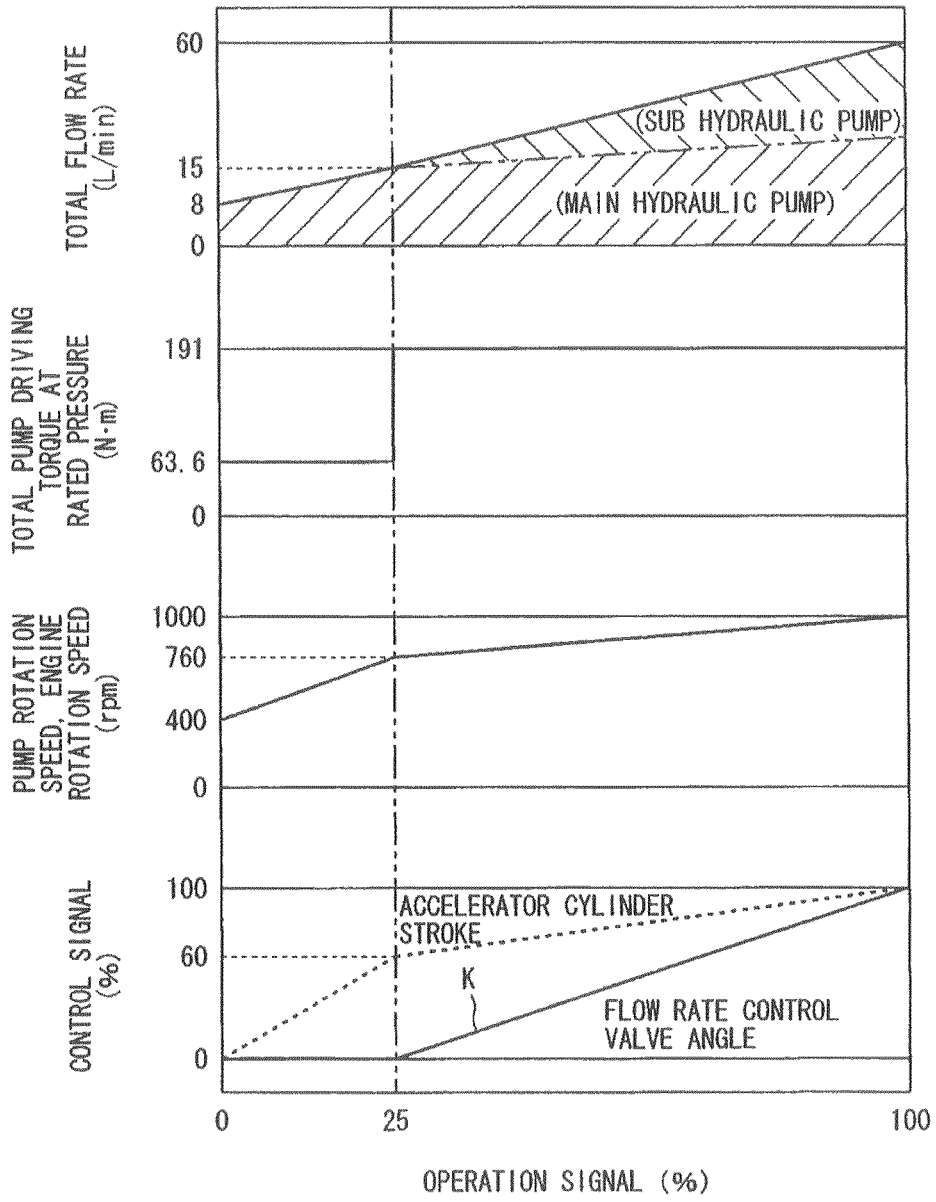
FIG. 7 is a diagram illustrating a predetermined control function (a control map used for the pressurized-oil supply amount control process) applied to a control device according to a third embodiment.

The predetermined control function and the corresponding pressurized-oil supply amount control process according to the third embodiment will be described below in further detail. FIG. 7 is a diagram illustrating the predetermined control function (a control map used for the pressurized-oil supply amount control process) applied to the control device according to the third embodiment.

The graphs shown in FIG. 7 illustrate the above-described control function (control map) that can be referenced as table data. The lowermost graph shows the angle of the spool of the flow rate control valve 5. The engine rotation speed, the total pump driving torque at the rated pressure, the total flow rate of the main and sub hydraulic pumps 7, 8 are shown above the lowermost graph in this order from bottom to top. The displacement of the main hydraulic pump 7 is 20 cm3/rev. The displacement of the sub hydraulic pump 8 is 40 cm3/rev. In connection with the numerical values in the graphs shown in FIG. 7, the following are assumed: the idling rotation speed of the engine is 400 rpm, the rated rotation speed is 1,000 rpm, the speed reduction ratio of the engine and the pump is 1 (engine rotation speed=pump rotation speed), and the rated pressure is 20 MPa.

Here, as described above, the discharge amount of the main hydraulic pump 7 is smaller than that of the sub hydraulic pump 8. In particular, the discharge amount of the main hydraulic pump 7 according to the present embodiment is set to a small value within a necessary and sufficient range for the inching operation of the crane.

Four ranges are set for the pressurized-oil supply amount control process in the controller 2 according to the input load signal. Specifically, a first range corresponds to the case where the input load signal is lower than 50% (first predetermined value). A second range corresponds to the case where the input load signal is higher than 50% (first predetermined value) and lower than 95% (second predetermined value). Moreover, a third range corresponds to the case where the input load signal is higher than 95% (second predetermined value) and lower than 100% (third predetermined value) or where an inching button 66 is operated to input the corresponding signal. A fourth range corresponds to the case where the input load signal is higher than 100% (third predetermined value).

Figure 8:
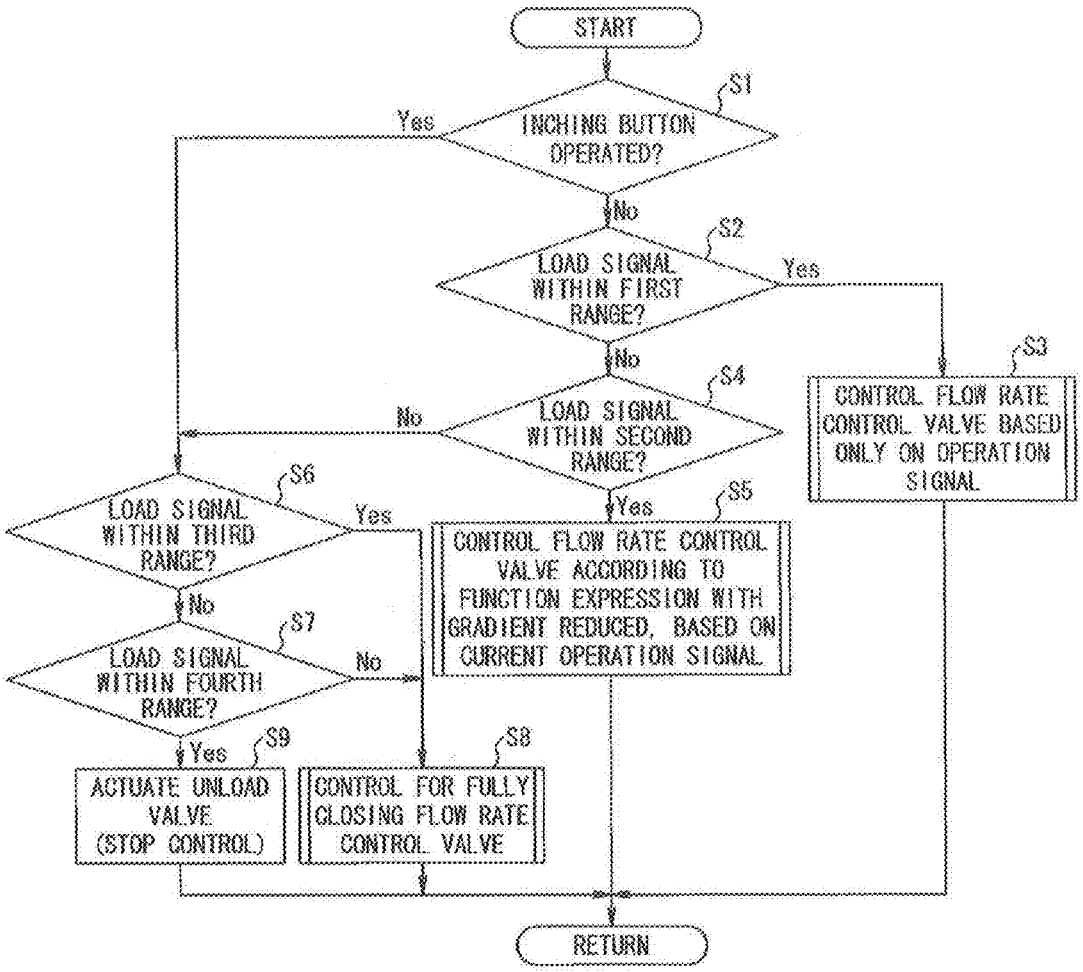
FIG. 8 is a flowchart of a program executed by a controller according to a third embodiment to carry out the pressurized-oil supply amount control process.
Figure 9:
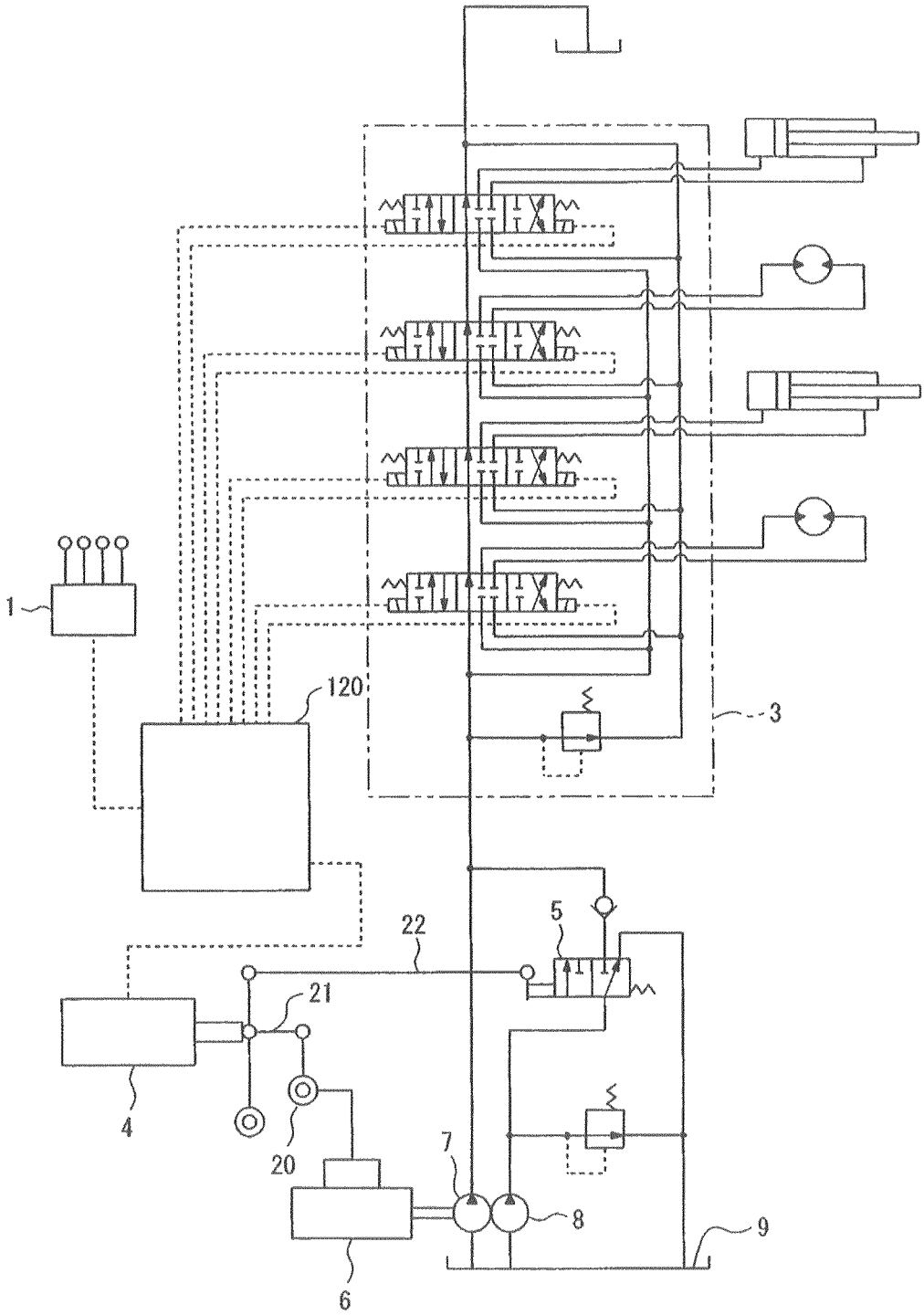
FIG. 9 is a diagram illustrating an example of a hydraulic circuit including a conventional pressurized-oil supply amount control device for a vehicle-mounted crane.

FIG. 8 is a flowchart of a program executed by the controller 2 according to the present invention to carry out the pressurized-oil supply amount control process. As shown in the figure, in an example of the present embodiment, when the program is executed in the controller 2, the process first proceeds to step S1.

In step S1, the controller 2 determines whether or not an inching button 66 on a radio controller 60 has been operated. When the inching button 66 has been operated (Yes), the process shifts to step S6. When the inching button 66 has not been operated (No), the process shifts to step S2. In step S2, the controller determines whether or not a load signal from an overload preventing device 10 is within the above-described first range. If the load signal is within the first range (Yes), the process shifts to step S3. If the load signal is not within the first range (No), the process shifts to step S4.

In step S3, a series of operations of controlling the flow rate control valve 5 based only on the operation signal are performed. Then, the process is returned. Specifically, this control is performed according to the predetermined function expression (basic function expression) K based on the lowermost graph in FIG. 8. The first range is set, for example, so as to prevent the crane from toppling down.

In step S4, the controller 2 determines whether or not the load signal is within the second range. If the load signal is within the second range (Yes), the process shifts to step S5. If the load signal is not within the second range (No), the process shifts to step S6.

In step S5, the flow rate control valve 5 is controlled so as to reduce the flow rate of the pressurized oil discharged from the sub hydraulic pump 8 as the input load signal increases. A series of operations of controlling the flow rate control valve 5 based only on the operation signal are performed. Then, the process is returned. Specifically, in this control, the predetermined function expression (basic function expression) K is multiplied by the reciprocal of a load factor so that the gradient of the function expression K shown in FIG. 7 decreases with increasing input load signal. Thus, according to the function expression with the gradient reduced, the flow rate control valve 5 is controlled based on the current operation signal.

In step S6, the controller 2 determines whether or not the load signal is within the above-described third range. If the load signal is within the third range (Yes), the process shifts to step S8. If the load signal is not within the third range (No), the process shifts to step S7.

In step S8, a series of operations of fully closing the flow rate control valve 5 are executed. Then, the process is returned. This inhibits the flow rate control valve 5 from being operated. Furthermore, in step S7, the controller 2 determines whether or not the load signal is within the above-described fourth range. If the load signal is within the fourth range (Yes), the process shifts to step S9. If the load signal is not within the fourth range (No), the process shifts to step S8. In step S9, a series of operations including control for activating the above-described unload relief valves 27, 29 are performed. Then, the process is returned. Thus, the pressurized oil is returned to the tank 9 side without passing through directional control valves 40, to stop the operation of the crane.

Now, the control of the flow rate of the flow rate control valve 5 based on the operation signal will be specifically described. Each of the directional control valves 40 in the above-described control valve 3 includes a transmitter (differential transmitter) that enables the operation amount of a spool of the directional control valve 40 to be determined. The total flow rate required for the crane is calculated from the operation amount. Based on the calculated required total flow rate, the required maximum operation amount of the spool of the flow rate control valve 5 is calculated.

Now, the effects and advantages of the pressurized-oil supply amount control device according to the third embodiment will be described.

In the pressurized-oil supply amount control device according to the third embodiment, the load signal corresponding to the load factor for the crane and the operation signal to the crane are each input to the controller 2. Based on the load signal and the operation signal, the single flow rate control valve 5 is controlled. The single flow rate control valve 5 can be used both to control the flow rate of the pressurized oil to be merged and to control the flow rate according to the load factor.

The controller 2 gives top priority to the load signal corresponding to the load factor for the crane, over the operation signal in controlling the flow rate control valve 5. Thus, the flow rate can be reliably brought into the desired condition according to the load factor for the crane.

Moreover, the four ranges are set for the controller 2 according to the load factor for the crane. The controller 2 is thus more suitable for controllably establishing the desired condition corresponding to the load factor for the crane.

That is, in the first range (the input load signal is lower than 50%), in which the load factor is relatively low, the above-described predetermined function expression (basic function expression) K remains unchanged. Thus, the flow rate control valve 5 is controlled based only on the operation signal to crane. This enables quick operations.

In the second range (the input load signal is at least 50% and lower than 95%), in which the load factor is moderate, the flow rate control valve 5 is controlled so as to reduce the flow rate of the pressurized oil discharged from the sub hydraulic pump 8 as the load signal increases. That is, the predetermined function expression K is multiplied by the reciprocal of the load factor to reduce the gradient of the function expression K. Thus, according to the function expression with the gradient reduced, the flow rate control valve 5 is controlled based on the current operation signal.

Moreover, in the third range (the input load signal is at least 95% and lower than 100%), in which the load factor is relatively high, the flow rate control valve 5 is controlled so as to be fully closed. Thus, in this case, all of the pressurized oil supplied to the directional control valves 40 in the control valve 3 is covered only by the pressurized oil discharged from the main hydraulic pump 7. Moreover, in the fourth range (the input load signal is at least 100%), in which the load factor exceeds the limit, the unload relief valves 27, 29 are actuated to return the pressurized oil to the tank 9 side to stop the operation of the crane. As a result, the current operation of the crane can be reliably stalled.

Furthermore, when the crane performs the inching operation, the flow rate control valve 5 is controlled so as to be fully closed. Thus, in this case, all of the pressurized oil supplied to the directional control valves 40 in the control valve 3 is covered only by the pressurized oil discharged from the main hydraulic pump 7. Consequently, a creeping system can be easily and inexpensively constructed.

Therefore, the pressurized-oil supply amount control device allows normal operations to be properly performed and enables the crane to be operated such that the flow rate is reliably controlled to the desired condition according to the load factor. Moreover, the creeping system can be easily and inexpensively constructed.

The pressurized-oil supply amount control device for the vehicle-mounted crane according to the present invention is not limited to the above-described embodiments. Of course, various modifications may be made to the embodiments without departing from the spirit of the present invention.

or example, in the above-described first embodiment, the displacements of the main hydraulic pump 7 and the sub hydraulic pump 8 are both 30 cm3/rev. However, the present invention is not limited to this. For example, the maximum discharge amount of the main hydraulic pump may be set to a value smaller than that of the sub hydraulic pump. This configuration is suitable for reducing the torque load on the engine when the engine rotation speed and the rotation torque are low. Furthermore, in this case, for example, the maximum discharge amount of the main hydraulic pump is preferably set equal to the necessary and sufficient discharge amount for the inching operation. This configuration is more suitable for reducing the torque load on the engine when the engine rotation speed and the rotation torque are low.

Furthermore, for example, in the above-described second embodiment, the desired one of the plurality of control functions can be selected via the operation input device 1. However, the present invention is not limited to this. For example, a dip switch may be provided on a substrate in the controller 2 and set to determine the optimum control function for the corresponding engine characteristics to be the above-described desired control function before shipment.

Additionally, in the above-described second embodiment, as a plurality of different control functions one of which can be selected in the pressurized-oil supply amount control process executed by the controller 2, the two types of control functions are used. However, the present invention is not limited to this. For example, the second embodiment may be configured such that one of at least three types of control functions can be selected.

Furthermore, for example, in the above-described third embodiment, the creeping system corresponds to the control in the pressurized-oil supply amount control process executed by the controller 2 when the inching button 66 is operated to input the corresponding signal. However, the present invention is not limited to this. For example, a switch that can be turned on and off may be interposed in a signal line 52 connecting the flow rate control valve 5 and the controller 2 together and may be operated to provide the creeping system. Even this configuration allows the creeping system to be easily and inexpensively constructed.

While the invention has been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A pressurized-oil supply amount control device for controlling a supply of pressurized oil to a crane mounted on a vehicle, the pressurized-oil supply amount control device comprising:

a main hydraulic pump and a sub hydraulic pump simultaneously driven by an engine of the vehicle;

a flow rate control valve configured to adjust a flow rate of the pressurized oil discharged from the sub hydraulic pump to a desired value;

a controller configured to control a rotation speed of the engine and the flow rate control valve in response to an operation signal input to the crane, wherein the pressurized oil discharged from the main hydraulic pump is merged with pressurized oil from the sub hydraulic pump adjusted by the flow rate control valve and the merged pressurized oil is supplied to a control valve used to drive the crane;

engine rotation speed control means for controlling the rotation speed of the engine, wherein the engine rotation speed control means includes a first rotation speed control in which the rotation speed of the engine is increased so as to vary in proportion to the rate of the operation signal input from an idling rotation speed to second rotation speed ensuring a necessary and sufficient torque for preventing insufficiency of a rotating torque of the engine, a second rotation speed control in which the rotation speed of the engine is maintained at the second engine rotation speed, and a third rotation speed control in which the rotation speed of the engine is increased in proportion to the rate of the operation signal input from the second engine rotation speed to a third engine rotation speed higher than the second engine rotation speed; and discharge flow rate control means for controlling the flow rate of pressurized oil discharged from the flow rate control valve, wherein the discharge flow rate control means includes a first flow rate control in which the flow rate control valve is fully close to supply only the pressurized oil from the main hydraulic pump to the control valve, a second flow rate control in which the pressurized oil from the sub hydraulic pump is merged with the pressurized oil discharged from the main hydraulic pump so that discharge amount of the merged pressurized oil varies in proportion to rate of the operation signal input before the merged pressurized oil is supplied to the control valve, and a third flow rate control in which the flow rate control valve is fully open to supply the control valve with possible maximum amount of pressurized oil discharged from the main hydraulic pump and the sub hydraulic pump, wherein the controller performs the first rotation speed control and correspondingly the first flow rate control when the rate of the operation signal input is in a first region in which the rate is lower than a first rate, performs the second rotation speed control and correspondingly the second flow rate control when the rate of the operation signal input is in a second region in which the rate is equal to or higher than the first rate and lower than a second rate higher than the first rate, and performs the third rotation speed control and correspondingly the third flow rate control when the rate of the operation signal input is in a third region in which the rate is equal to or higher than the second rate.

2. The pressurized-oil supply amount control device according to claim 1, wherein the engine rotation speed control means and the discharge flow rate control means of the controller increase a total flow rate of the pressurized oil supplied to the control valve in proportion to the rate of the operation signal input in all the regions.

3. The pressurized-oil supply amount control device according to claim 1, wherein the control valve is of a stack type and comprises:

a plurality of directional control valves based on an indirect driving scheme to drive respective actuators of the crane;

a flow rate control valve adjusting the flow rate of the pressurized oil discharged from the sub hydraulic pump and merging the pressurized oil from the sub hydraulic pump with the pressurized oil discharged from the main hydraulic pump to feed the merged pressurized oil to the plurality of directional control valves;

two unload relief valves interposed between the main hydraulic pump and the plurality of directional control valves and between the sub hydraulic pump and the plurality of directional control valves, respectively;

a pressure reducing valve; and a back pressure valve provided so as to acquire pilot oil required to drive the plurality of directional control valves only from the main hydraulic pump, the directional control valves, the flow rate control valve, the unload relief valves, the pressure reducing valve and back pressure valve being stacked so as to make up the stack type.

4. A pressurized-oil supply amount control device for controlling a supply of pressurized oil to a crane, the pressurized-oil supply amount control device comprising:

a main hydraulic pump of a fixed displacement type and a sub hydraulic pump of a fixed displacement type simultaneously driven by an engine of a vehicle on which the crane is mounted;

a flow rate control valve adjusting a flow rate of pressurized oil discharged from the sub hydraulic pump to a desired value; and a controller individually controlling a rotation speed of the engine and the flow rate control valve in response to an operation input to the crane, wherein pressurized oil discharged from the main hydraulic pump is merged with pressurized oil discharged from the sub hydraulic pump having the flow rate adjusted to be the desired value by the flow rate control valve and the merged pressurized oil is supplied to a control valve used to drive the crane, wherein a plurality of relationships between the operation input to the crane and both the rotation speed of the engine and the flow rate of the pressurized oil set by the flow rate control valve is set for the controller, each of the plurality set to correspond to each vehicle having different engine characteristics, and wherein a desired relationship of the set plurality of relationships is selectable, and the controller individually controls the rotation speed of the engine and the flow rate of the pressurized oil set by the flow rate control valve by accelerating an increase in the rotation speed of the engine by use of only the main hydraulic pump until the rotation speed of the engine reaches a defined rotation speed, suppressing the increase in the rotation speed of the engine when the rotation speed of the engine reaches the defined rotation speed, and then, with suppressing the increase in the rotation speed of the engine, opening the flow rate control valve to increase the flow rate in total proportionally by merging the pressurized oil discharged from the main hydraulic pump with the pressurized oil discharged from the sub hydraulic pump.

5. A pressurized-oil supply amount control device for controlling a supply of pressurized oil to a crane, the pressurized-oil supply amount control device comprising:

a main hydraulic pump of a fixed displacement type and a sub hydraulic pump of a fixed displacement type simultaneously driven by an engine of a vehicle on which the crane is mounted;

a flow rate control valve adjusting a flow rate of pressurized oil discharged from the sub hydraulic pump to a desired value; and a controller individually controlling rotation speed of the engine and the flow rate control valve in response to an operation input to the crane;

wherein the pressurized oil discharged from the main hydraulic pump is merged with pressurized oil discharged from the sub hydraulic pump having the flow rate adjusted to be the desired value by the flow rate control valve and the merged pressurized oil is supplied to a control valve used to drive the crane, wherein the control valve used to drive the crane is of a stack type and comprises:

a plurality of directional control valves based on an indirect driving scheme to drive respective actuators of the crane;

a flow rate control valve adjusting the flow rate of the pressurized oil discharged from the sub hydraulic pump and merging the pressurized oil from the sub hydraulic pump with the pressurized oil discharged from the main hydraulic pump to feed the merged pressurized oil to the plurality of directional control valves;

two unload relief valves interposed between the main hydraulic pump and the plurality of directional control valves and between the sub hydraulic pump and the plurality of directional control valves, respectively;

a pressure reducing valve; and a back pressure valve provided so as to acquire pilot oil required to drive the plurality of directional control valves only from the main hydraulic pump, the directional control valves, the flow rate control valve, the unload relief valves, the pressure reducing valve and back pressure valve being stacked so as to make up the stack type;

wherein a plurality of relationships between the operation input to the crane and both the rotation speed of the engine and the flow rate of the pressurized oil set by the flow rate control valve is set for the controller, each of the plurality set to correspond to each vehicle having different engine characteristics; and wherein a desired relationship of the set plurality of relationships is selectable, and the controller individually controls the rotation speed of the engine and the flow rate of the pressurized oil set by the flow rate control valve based on the operation input to the crane and the selected desired relationship.

6. A pressurized-oil supply amount control device for controlling a supply of pressurized oil to a crane mounted on a vehicle, the pressurized-oil supply amount control device comprising:

a main hydraulic pump and a sub hydraulic pump simultaneously driven by an engine of the vehicle;

a flow rate control valve adjusting the flow rate of the pressurized oil discharged from the sub hydraulic pump to a desired value;

a main hydraulic pump unload valve and a sub hydraulic pump unload valve capable of bypassing pressurized oil discharged from the main hydraulic pump and the sub hydraulic pump to a tank; and a controller capable of controlling rotation speed of the engine and the flow rate control valve in response to an operation signal to the crane, wherein the pressurized oil discharged from the main hydraulic pump is merged with the pressurized oil from the sub hydraulic pump adjusted by the flow rate control valve and the merged pressurized oil is supplied to each directional control valve used to drive the crane, wherein in addition to the operation signal to the crane, a load signal corresponding to a load factor for the crane is input to the controller, and wherein the controller controls the flow rate control valve based on the input operation signal, and controls the flow rate control valve or operates each of the unload valves based on the input load signal so that flow rate of the pressurized oil discharged from the sub hydraulic pump is reduced when the input load signal is large, as compared to a case where the load signal is small.

7. The pressurized-oil supply amount control device according to claim 6, wherein when the input load signal is within a first range in which the signal is smaller than a first predetermined value, the flow rate control valve is controlled based only on the operation signal to the crane, wherein when the input load signal is within a second range in which the signal exceeds the first predetermined value and is smaller than a second predetermined value larger than the first predetermined value, the flow rate control valve is controlled such that the flow rate of the pressurized oil discharged from the sub hydraulic pump is reduced with increasing load signal, and is controlled based on the operation signal, wherein when the input load signal is within a third range in which the signal exceeds the second predetermined value and is smaller than a third predetermined value larger than the second predetermined value, the flow rate control valve is controlled so as to be fully closed, and wherein when the input load signal is within a fourth range in which the signal exceeds the third predetermined value, each of the unload valves is operated to bypass the pressurized oil from the main hydraulic pump and the sub hydraulic pump to the tank.

* * * * *